US007306885B2

(12) United States Patent
Miyakawa

(10) Patent No.: US 7,306,885 B2
(45) Date of Patent: Dec. 11, 2007

(54) TONER, PRODUCTION METHOD THEREOF, AND IMAGE FORMING APPARATUS USING SAME

(75) Inventor: Nobuhiro Miyakawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 11/505,372

(22) Filed: Aug. 17, 2006

(65) Prior Publication Data

US 2006/0275680 A1 Dec. 7, 2006

Related U.S. Application Data

(63) Continuation of application No. 10/771,618, filed on Feb. 5, 2004, now abandoned.

(30) Foreign Application Priority Data

Feb. 6, 2003 (JP) ..... 2003-029630
Apr. 15, 2003 (JP) ..... 2003-109936

(51) Int. Cl.
*G03G 15/01* (2006.01)

(52) U.S. Cl. ..... 430/45.3; 430/45.51; 430/47.2

(58) Field of Classification Search ..... 430/45, 430/47, 45.3, 45.51, 47.2
See application file for complete search history.

(56) References Cited

U.S. PATENT DOCUMENTS 6,503,675 B1 1/2003 Kabai
2003/0095814 A1 5/2003 Miyakawa et al.

FOREIGN PATENT DOCUMENTS

JP 01-281458 11/1989
JP 06-011898 A 1/1994
JP 6-194943 A 7/1994
JP 07-064366 A 3/1995
JP 07-306564 A 11/1995

(Continued)

OTHER PUBLICATIONS

English language machine translation of JP 06-011898 (1994).*

(Continued)

*Primary Examiner*—Christopher D. RoDee
(74) *Attorney, Agent, or Firm*—Sughrue Mion, PLLC

(57) ABSTRACT

The present invention provides toners of different colors in which coloring agents of at least four unicolors are internally added to, respectively, and hydrophobic silica particles and metallic soap particles are externally added to toner mother particles, wherein color superposition of the toners is conducted during development of latent images on a latent image carrier or during transfer to a recording medium after the development, being characterized in that the difference (absolute value) between the work functions of two of said toners is 0.02 eV or more, the color superposition is conducted with the toners sequentially from the toner having the largest work function in descending order of work function of the toners, and the difference (absolute value) between the work function of the toner mother particles and the work function of the metallic soap particles is 0.15 eV or less, thereby improving the transfer efficiency, enabling the extreme reduction in amount of waste toner, and enabling the reduction in apparatus size, and provides a production method of the toners and an image forming apparatus employing the toners.

7 Claims, 8 Drawing Sheets

FOREIGN PATENT DOCUMENTS

| | | | |
|---|---|---|---|
| JP | 08-227171 | A | 9/1996 |
| JP | 08-248779 | A | 9/1996 |
| JP | 08-297413 | A | 11/1996 |
| JP | 09-062030 | A | 3/1997 |
| JP | 09-288380 | | 11/1997 |
| JP | 09-319179 | A | 12/1997 |
| JP | 10-239894 | | 9/1998 |
| JP | 11-218957 | A | 8/1999 |
| JP | 11-323396 | A | 11/1999 |
| JP | 2000-003068 | A | 1/2000 |
| JP | 2000-242152 | A | 9/2000 |
| JP | 2001-034008 | | 2/2001 |
| JP | 2001-051443 | A | 2/2001 |
| JP | 2001-092173 | | 4/2001 |
| JP | 2002-131973 | A | 5/2002 |
| JP | 2002-169330 | A | 6/2002 |
| JP | 2002-258567 | A | 9/2002 |
| JP | 2002-278159 | | 9/2002 |
| JP | 2003-029449 | | 1/2003 |
| JP | 2004-093580 | | 3/2004 |

OTHER PUBLICATIONS

Diamond, Arthur S. & David Weiss (eds.) Handbook of Imaging Materials. New York: Marcel-Dekker, Inc., (Nov. 2001) pp. 145-168.

* cited by examiner (A)

(B)

(A)

(B)

(A)

(B)

(A)

(B)

TONER, PRODUCTION METHOD THEREOF, AND IMAGE FORMING APPARATUS USING SAME

This is a continuation of application Ser. No. 10/771,618 filed Feb. 5, 2004, and now abandoned. The entire disclosure of the prior application, application Ser. No. 10/771,618 is considered part of the disclosure of the present application and is hereby incorporated by reference.

BACKGROUND OF THE INVENTION

The present invention relates to toners, to be used for electrophotograph, each in which a coloring agent selected from a group consisting of at least yellow, magenta, cyan, and black is internally added, a production method thereof, and a full-color image forming apparatus using the same.

There have been known various image forming apparatuses as full-color image forming apparatuses.

As an example, a first color image forming apparatus comprises a latent image carrier and a plurality of developing devices which are arranged around the latent image carrier and each of which holds a toner in which a coloring agent selected from a group consisting of at least yellow, magenta, cyan, and black is internally added. In the first color image forming apparatus, an electrostatic latent image is formed on the image carrier and is developed with the toners by the developing devices so as to sequentially superpose unicolors, thereby forming a full color toner image. Then, the full color toner image formed by superposing unicolors is directly transferred to a recording medium at once and the full color toner image on the recording medium is fixed with heat and pressure. Alternatively, the full color toner image formed on the latent image carrier by color superposition is transferred to an intermediate transfer medium at once and, after that, is further transferred to a recording medium and the full color toner image on the recording medium is fixed with heat and pressure.

As another example, a second color image forming apparatus comprises a latent image carrier and a plurality of developing devices which are arranged around the latent image carrier and each of which holds a different unicolor toner. In the second color image forming apparatus, electrostatic latent images are formed on the image carrier and are sequentially developed with the respective toners by the developing devices. The toner images for the respective colors formed on the latent image carrier are sequentially transferred onto an intermediate transfer medium to superpose colors, thereby forming a full color toner image on the intermediate transfer medium. Then, the full color toner image is transferred to a recording medium at once and the full color toner image on the recording medium is fixed with heat and pressure.

As another example, a third color image forming apparatus comprises toner image forming means each of which is provided for each toner containing a coloring agent selected from a group consisting of at least yellow, magenta, cyan, and black. Each toner image forming means comprises a latent image carrier and a developing device wherein an electrostatic latent image is formed on the latent image carrier and is developed by the developing device. In the third color image forming apparatus, toner images of the respective colors on the latent image carriers are sequentially transferred to an intermediate transfer medium to superpose colors, thereby forming a full color toner image on the intermediate transfer medium. Then, the full color toner image is transferred to a recording medium at once and the full color toner image on the recording medium is fixed with heat and pressure.

In the aforementioned first color image forming apparatus, different unicolor toner images are superposed on the single photoreceptor. In the second color image forming apparatus, respective unicolor toner images formed on the single photoreceptor are superposed on the recording medium or the intermediate transfer medium so as to form a full color toner image. In the third color image forming apparatus, different unicolor toner images are formed on the photoreceptors, respectively and then superposed on the recording medium or the intermediate transfer medium so as to form a full color toner image.

Any of such color image forming apparatuses as mentioned above has such a problem that the transfer efficiency of toner images becomes insufficient during the superposition of unicolors. The insufficient transfer efficiency may cause the toner scattering and/or color irregularity, thus developing a color different from a desired color.

There is also a problem that, in case of applying a transfer voltage by a constant voltage power source to transfer formed toner images, not all the toner images are transferred correctly. For this, it is required to apply so-large transfer voltage.

As the amount of toners not used in image formation increases, the consumption of toners increases. In case that residual toners not transferred to the photoreceptor or the intermediate transfer medium are collected as waste toners by a cleaning device, the increase of residual toners not transferred leads to the increase of waste toners, thus accelerating the deterioration of cleaning members.

For storing a large amount of waste toners, a large-capacity waste toner container is required. The large-capacity waste toner container increases the volume of the image forming apparatus, making the fulfillment of requirement of reducing the size of the image forming apparatus impossible. This is also a problem.

In case of collecting untransferred toners in the developing device and reusing the toners in next development, as the amount of untransferred toners increases, the percentage of toner of which charging property and the like are deteriorated is increased, thus leading to affect on the characteristics of formed image. This is also a problem.

For heightening the resolution of formed color image and reducing the consumption of toners, toners having small particle diameters are used. However, diminish in particle diameter of toner lowers the fluidity of the toner. Particularly in case of non-magnetic single-component development, this makes triboelectric charge with the surface of a development roller or a regulating blade difficult, causing a problem of not imparting enough charge. Therefore, charge distribution is generated in toner so that it is inevitable that a negatively charged toner contains positively charged toner particles, thus causing a problem of fog in non-image portions of the image carrier. To prevent the occurrence of fog, it is known to increase the regulation pressure in case of non-magnetic single-component development. However, increase in the regulation pressure may cause excessive charge of toner, thus generating a tendency toward reduction in toner concentration during development and a tendency toward reduction in transfer efficiency.

For example in JP-A-06194943, in order to solve the aforementioned many problems, it has been proposed to limit the amount of adhering toner on the development roller after regulation in a proper range. Also, in JP-A-2002131973, it has been proposed to use small-particle toner and to define the upper limits in amount of the respective unicolor toners adhering to a recording medium in order to improve the charging property, the image quality, and the granularity. In JP-A-08248779, JP-A-2000206755, JP-A-200231933, JP-A-200231933, JP-A-05307310, and the like, for a full-color image, it has been proposed to determine the transfer sequence among unicolor toners of yellow, magenta, and cyan and black toners.

In JP-A-10207164, it has been proposed to start development with toner particles having small charge. In JP-A-10260563, it has been proposed to increase the transfer voltage for every color to improve the transfer efficiency. In JP-A-0527548, it has been proposed to set the transfer voltage so as to increase the transfer efficiency of toner particles in the lowest layer.

In JP-A-2000128534, it has been proposed to use hydrophobic rutile/anatase type titanium oxide to improve external additive particles, thus preventing external additives from being embedded due to friction. In JP-A-200183732, it has been proposed to set the percentage of rutile/anatase mixed crystal type titanium oxide and hydrophobic silica particles which strongly adhere toner mother particles to 90-98%, thereby achieving good triboelectric characteristic and thus obtaining a color image with no soilure due to toner scattering and no fog.

In JP-A-200122118, it has been proposed to add silica particles and titanium oxide particles as external additives to toner mother particles and to set the liberation ratio of silica to 0.5-8% and set the liberation ratio of titanium oxide to 0.5-5%, thereby preventing defects of transferred colorant in solid image, fog, and filming. In JP-A-200272544, it has been proposed to add silica particles and titanium oxide particles to toner particles with high degree of circularity, and to set the number liberation ratio of titanium oxide to 1.00-50.00% and set the number liberation ratio of silica to 0.01-4.00% such that the number liberation ratio of titanium oxide is larger than the number liberation ratio of silica.

In JP-A-08272132, JP-A-08314280, it has been proposed to add metallic soap (zinc stearate) as external additive so as to make developer which can exhibit excellent transfer efficiency, does not allow the generation of internal void phenomenon, and hardly produce fog. In JP-A-200210799, it has been proposed that the addition of metallic soap particles to toner is effective in extending the life of a photoreceptor.

Further in JP-A-11167224, it has been proposed to apply metallic soap not only to toner but also to a photoreceptor, thereby preventing the adhesion of toner account for scumming.

Furthermore in JP-A-08272228, it has been proposed to apply metallic soap to an intermediate transfer medium, thereby improving its separation characteristic relative to toner and thus improving the transfer efficiency.

In JP-A-11323396, it has been proposed to set the particle diameter of metallic soap externally added to toner mother particles to 4 μm or less, thereby improving the cleaning characteristic of toner.

Moreover in JP-A-200151443, it has been proposed to set the particle diameter of metallic soap to 5 μm or less and also use titanium oxide and silica particles with the metallic soap, thereby preventing the production of spent toner, the occurrence of filming, and the generation of blemishes in a photoreceptor.

In JP-A-2002169330, it has been proposed to externally add fatty calcium salt to toner mother particles produced in the polymerization method, thereby preventing the wear of a cleaning blade and thus preventing the passing of toner particles and the sticking of toner particles.

In JP-A-0611898, it has been proposed that in unicolor toners for forming a full color image, setting the difference in work function of two of the unicolor toners to be 0.5 eV or less enables the formation of an image which is excellent in color reproducibility.

Since there is a limit to improve the toner's transfer efficiency in a developer of which toner mother particles are treated with external additives, however, any of the aforementioned propositions can not extremely reduce the amount of waste toners and therefore requires a waste toner container of a certain level of size.

As another type of color image forming apparatus, there has been known an image forming apparatus of a tandem system without an intermediate transfer medium so that a toner image is directly transferred to a recording medium. The tandem system allows the reduction in size of the image forming apparatus and also enables the high-speed formation of a color image.

In the tandem-type image forming apparatuses, the transfer sequence or the like has been considered in order to form a color image having excellent image quality. For example, in JP-A-09319179, it has been proposed to adjust the amount of adhering toner on a photoreceptor to be previously transferred to be larger than the amount of adhering toner on the photoreceptor to be transferred later in the process of transferring an image to a recording medium, thereby providing a color image having excellent color balance.

This is because adjusting the amount of adhering toner to be previously developed and transferred to be larger than that of the next one prevents the disruption of color balance due to reduction in amount of previously transferred toner because some toner particles are reversely transferred to the photoreceptor for the next color during the development with the next color. However, this proposition does not prevent the generation of reversely transferred toner particles as a cause. That is, this proposition does not prevent the generation of reversely charged toner particles.

In JP-A-0764366, it has been proposed to increase the adhesion force between toner and a transfer medium by pressing the toner on the transfer medium after transfer with pressure means from both sides of the transfer medium, thereby preventing the generation of reversely transferred toner particles.

Since it is required to separately provide at least three pressure means, however, the size of the image forming apparatus must be increased, making the fulfillment of requirement of reducing the size of the image forming apparatus impossible.

In JP-A-2000242152, it has been proposed to provide a reversely transferred toner removing means having a polarity opposite to that of toner at a downstream side of a transferred portion of each of photoreceptors at least from the second one to the last one from the upstream side of the traveling direction of a feeding body for recording media in order to remove the reversely transferred toner particles.

However, this method can not prevent the generation of reversely transferred toner particles so that the amount of waste toner is increased and a large-capacity waste toner container is therefore required. The large-capacity waste toner container does not allow the reduction in size of the image forming apparatus.

In order to improve the image quality of formed color images, unicolor toners having relatively small particle diameter are used. In order to improve the transfer efficiency, conglobated toner is used. Since diminish in particle diameter of toner lowers the fluidity of the toner, however, this makes triboelectric charge with the surface of a development roller or a regulating blade difficult, causing a problem of not obtaining enough charge. Therefore, uneven charge distribution is generated in toner so that it is inevitable that even a negatively charged toner contains positively charged toner particles, thus causing a problem of fog in non-image portions of the image carrier.

In order to prevent the occurrence of fog, it is known to increase the regulation pressure in case of non-magnetic single-component development. However, increase in the regulation pressure may cause excessive charge of toner, thus generating a tendency toward reduction in toner concentration during development and a tendency toward reduction in transfer efficiency.

In JP-A-06194943, JP-A-08297413, JP-A-09062030, JP-A-11218957, and the like, it has been proposed to limit the amount of adhering toner on a development roller after regulation in a proper range. However, it is difficult to prevent the occurrence of fog and the generation of reversely transferred toner.

In JP-A-2002131973, a full color image forming method has been proposed to use small-particle toner and to define the upper limits in amount of the respective unicolor toners adhering to a recording medium in order to improve the charging property, the image quality, and the granularity. Though this method is effective in improvement of low-temperature fixing property for uniformly fusing toner, it is not effective in prevention of generation of reversely transferred toner.

In JP-A-07306564, an image forming apparatus has been proposed which is an image forming apparatus in which images are transferred from a plurality of image carrier drums sequentially arranged to a recording medium and is characterized in that an image carrier drum for forming a black toner image is arranged at the most upstream side of a feeding belt for feeding a recording medium.

Also in JP-A-7306564, a color image forming apparatus has been proposed in which the first development is conducted with yellow toner at the most upstream side and the final development is conducted with black toner at the most downstream side.

These are for preventing problems such as retortion of a cleaning blade only during the development with black toner and are not effective in prevention of the occurrence of fog and the generation of reversely transferred toner particles and in prevention of color registration error.

In JP-A-2002258567, JP-A-08227171, JP-A-2000003068, and the like, it has been proposed that a toner which is excellent in transfer property and cleaning property and hardly causes the scattering of toner particles is obtained by combination of toner particles of which average degree of circularity is high, silicide particles and silica particles which have different particle diameters.

However, none of these has been made for preventing the generation of reversely transferred toner particles.

It is an object of the present invention to provide a plurality of unicolor toners with which the color superposition is conducted during the development on a latent image carrier on which an electric latent image is formed or the color superposition is conducted during transfer to a recording medium after development, a production method thereof, and an image forming apparatus employing the toners, wherein the toners can provide high transfer efficiency, can prevent the scattering of toner particles, color registration error and toner dispersal, disturbance in transferred image, defects of transferred colorant, and uneven transfer, can exhibit excellent color reproducibility, enables the extreme reduction in amount of waste toner collected by cleaning, enables the reduction in apparatus size, and can extend the lives of a latent image carrier and a cleaning blade so as to achieve the low running cost.

It is another object of the present invention to provide an image forming apparatus of tandem system in which toner images formed on latent image carriers are sequentially transferred to a recording medium fed by a feeding belt, wherein the transfer of a toner image is not affected by a toner image which was previously transferred and the image forming apparatus does not allow the occurrence of color registration error among the respective unicolor toner images, can provide excellent color reproducibility, and does not allow the occurrence of scattering of toner particles and the generation of reversely transferred toner particles.

SUMMARY OF THE INVENTION

Figure 1:
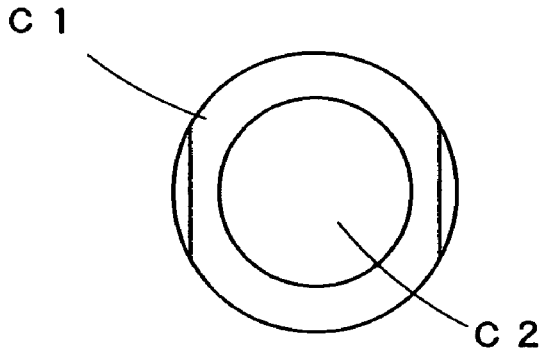
FIGS. 1(A) and 1(B) are illustrations for explaining a sample measurement cell used for measuring work functions.
Figure 1:
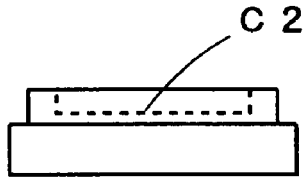

Toners of the present invention are toners of different colors each in which a coloring agent selected from a group consisting of at least yellow, magenta, cyan, and black is internally added to and hydrophobic silica particles and metallic soap particles are externally added to toner mother particles, wherein color superposition of the toners is conducted during development of latent images on a latent image carrier or during transfer to a recording medium after the development, and are characterized in that the difference as an absolute value between the work functions of two of said toners is 0.02 eV or more, the color superposition is conducted with the toners sequentially from the toner having the largest work function in descending order of work function of the toners, and the difference as an absolute value between the work function of the toner mother particles and the work function of the metallic soap particles is 0.15 eV or less.

When the second toner is superposed on the first toner which has been previously developed, the third toner is superposed on the second toner, and the fourth toner, if exists, is superposed on the third toner during developing electrostatic latent images on the latent image carrier with the toners, the work functions of the respective toners are set to decent along the development order, whereby the transfer of charge (electrons) can be achieved between the adjacent toners, that is, from the second toner to the first toner, from the third toner to the second toner, and from the fourth toner to the third toner, with the result that electrons can be concentrated to the first toner. Accordingly, the latent image carrier and the toner layer are strongly attracted to each other by electric forces, that is, image forces and electrostatic forces, thereby preventing the toner scattering, color registration error, and the toner dispersal during development for every color.

Since the development order of the toners for sequentially superposing the colors is the descending order of the work functions of the toners, the toners are attracted to each other without being repelled and the charge of the toner superposed on the former toner can be controlled to be smaller than that of the former toner. Therefore, even with different thickness of the toner layer, the reduction in transfer efficiency of the respective unicolor toners is minimized, thereby enabling the transfer to the recording medium with relatively small transfer voltage. Not only the transfer efficiency is improved, but also irregularities in image, defects of transferred colorant, and unevenness in transfer can be prevented and the color reproducibility is improved.

By employing metallic soap particles as external additive particles together with hydrophobic silica particles, the liberation of the external additive particles such as the hydrophobic silica particles from the toner mother particles can be reduced, thereby stabilizing the charge of toner particles. Even if successive printing is conducted, the reduction in amount of fog toner and in amount of scattered toner can be achieved, thereby maintaining the formation of high-quality images and preventing the increase in amount of cleaned toner.

Toners are characterized in that the toners are four unicolor toners of yellow, magenta, cyan, and black, wherein the largest work function among work functions of the toners is in a range of from 5.8 eV to 5.6 eV, the second one is in a range of from 5.7 eV to 5.5 eV, the third one is in a range of from 5.6 eV to 5.4 eV, and the fourth one is in a range of from 5.5 to 5.3 eV.

Toners are characterized in that the work functions of the toner mother particles and the metallic soap particles are in a range of from 5.3 eV to 5.8 eV.

Toners are characterized in that the work function of the hydrophobic silica particles is smaller than the work function of the toner mother particles.

The toners are characterized in that the toners are single-component non-magnetic toners.

Toners are characterized in that the number-mean particle diameter of each toner is from 4.5 μm to 9 μm.

Toners are characterized in that the degree of circularity of each toner is from 0.94 to 0.98, wherein the degree of circularity is represented by a ratio $L_0/L_1$ wherein "$L_1$" is the circumferential length (μm) of a projected image of an object toner particle and "$L_0$" is the circumferential length (μm) of a perfect circle having the same area as that of the projected image.

Toners are characterized in that the toners are prepared by polymerizing a polymerizable monomer and/or oligomer containing a coloring agent.

Toners of the present invention are toners to be used in an image forming apparatus comprising a plurality of latent image carriers for different colors and a feeding belt for feeding a recording medium, wherein latent images formed on the latent image carriers are developed with the toners, after that, are transferred to a recording medium on the feeding belt, and then are fixed so as to form a color image, and is characterized in that the latent image carriers are arranged such that the toners to be used for development are arranged in descending order of work function of the toners from the upstream side to the downstream side of the feeding belt and that each toner contains at least hydrophobic silica and hydrophobic titania as the fluidity improving agents of the toner.

A production method of the aforementioned toners is a method characterized in that after the hydrophobic silica particles are externally added to the toner mother particles, metallic soap particles having a work function of which difference as an absolute value from the work function of the toner mother particles is 0.15 eV or less are externally added to the toner mother particles.

An image forming apparatus of the present invention is an image forming apparatus in which electrostatic latent images formed on an image carrier are developed with toners of different colors each in which a coloring agent selected from a group consisting of at least yellow, magenta, cyan, and black is internally added to and hydrophobic silica particles and metallic soap particles are externally added to toner mother particles to form toner images and, after that, the toner images are transferred to a recording medium, wherein color superposition of the toners is conducted during the development of latent images on the latent image carrier or during the transfer to the recording medium after the development, and is characterized in that the difference as an absolute value between the work functions of two of said toners is 0.02 eV or more, the color superposition is conducted with the toners sequentially from the toner having the largest work function in descending order of work function of the toners, the difference as an absolute value between the work function of the toner mother particles and the work function of the metallic soap particles is 0.15 eV or less, and the work function of the latent image carrier is larger than the work function of the toner having the smallest work function.

An image forming apparatus is characterized in that the difference as a absolute value between the work function of the latent image carrier and the work function of the toner having the smallest work function is 0.07 eV or less.

An image forming apparatus is characterized in that the work function of the latent image carrier is from 5.35 eV to 5.6 eV.

An image forming apparatus is characterized in that the toners are negatively chargeable toners and the latent image carrier is a negatively chargeable organic photoreceptor so that the image forming apparatus conducts the reversal development.

An image forming apparatus is characterized in that the toners are non-magnetic single-component toners and the feeding amount of each toner at a developing device is controlled to be 0.5 mg/cm$^2$ or less by a regulating blade into a thin layer.

An image forming apparatus is characterized in that the toners are non-magnetic single-component toners and the amount of each toner developing the image on the latent image carrier is set to be 0.55 mg/cm$^2$ or less.

An image forming apparatus is characterized in that the recording medium is a paper sheet or a synthetic resin film.

In the image forming apparatus of the present invention, the work function of the photoreceptor is set to be larger than the work function of the toner having the smallest work function, thereby improving the transfer efficiency of toner layer and significantly reducing the amount of residual toner particles remaining on the latent image carrier after transfer. As a result of this, the cleaning load is significantly reduced. Further, the reduction in abrasion of the latent image carrier as the function of the metallic soap particles and the reduction in amount of cleaned toner are achieved. Therefore, the capacity of a container for collecting cleaned toner can be extremely reduced, thereby allowing the reduction in size of the image forming apparatus.

Further, an image forming apparatus of the present invention is an image forming apparatus comprising a plurality of latent image carriers for different colors and a feeding belt for feeding a recording medium, wherein latent images formed on the latent image carriers are developed with toners, after that, are transferred to a recording medium on the feeding belt, and then are fixed so as to form a color image, being characterized in that the latent image carriers are arranged such that the toners to be used for development are arranged in descending order of work function of the toners from the upstream side to the downstream side of the feeding belt so that the development, transfer, and fixing are conducted with the toners in the descending order of work function.

Since the toners are arranged sequentially from a toner having a larger work function to a toner having a smaller work function, that is, in descending order of work function of the toners as mentioned above, the toner previously transferred to the recording medium can be prevented from being reversely transferred to the photoreceptor of the next toner image forming means and the adhesion between toner layers can be improved, thereby forming a color image in which color registration error is prevented and which is excellent in color reproducibility.

Furthermore, an image forming apparatus of the present invention is an image forming apparatus comprising a plurality of latent image carriers for different colors and a feeding belt for feeding a recording medium, wherein latent images formed on the latent image carriers are developed with toners, after that, are transferred to a recording medium on the feeding belt, and then are fixed so as to form a color image, being characterized in that the latent image carrier for forming a toner image with a black toner is arranged at the most upstream side or the most downstream side of the feeding belt, and the other latent image carriers for forming toner images with the other unicolor toners are arranged in descending order of work function of the toners from the upstream side to the downstream side so that the development, transfer, and fixing are conducted with the toners in the this order.

By arranging the latent image carrier for forming a toner image with a black toner at the most upstream side or the most downstream side of the feeding belt as mentioned above, not only the replacement of the unit of black toner can be facilitated, but also the unit of black toner can be designed to have a larger size than that of the units of other unicolor toners because the unit of black toner can be placed at an end of the unit array so as to increase the possible number of print pages for monochrome images developed with the black toner. These are advantage because the opportunity of image formation with black toner is generally higher than those of the other unicolor toners. Accordingly, an image forming apparatus with reduced frequency of replacing the unit of black toner can be provided.

An image forming apparatus is characterized in that the toners are non-magnetic single component toners.

An image forming apparatus is characterized in that the toners are negatively chargeable toners and development devices for conducting reversal development are employed.

An image forming apparatus is characterized in that the latent image carriers are negatively chargeable organic photoreceptors.

An image forming apparatus is characterized in that the feeding belt disposed inside the image forming apparatus is obliquely arranged relative to the horizontal direction.

Since the feeding belt disposed inside the image forming apparatus is obliquely arranged so that the latent image carriers are also obliquely arranged, an image forming apparatus with excellent volume efficiency in which the inner space is utilized effectively can be provided.

An image forming apparatus is characterized in that the peripheral velocity of each development roller is set to be higher than that of each latent image carrier to have a ratio of peripheral velocity of from 1.1 to 2.5, and the rotational direction of the latent image carrier and the rotational direction of the development roller are the same.

By setting the difference in peripheral velocity between each development member and each latent image carrier to be a predetermined value to ensure the required amount of toner adhering to the latent image carrier, a high-quality color toner image with high transfer characteristics and without color registration error and toner scattering can be produced as a result of uniform charge of the toners and the transfer of electrons (charge) due to work function differences.

DESCRIPTION OF THE PREFERRED EMBODIMENTS

Toners of the present invention are toners of different colors in which a coloring agent selected from a group consisting of at least yellow, magenta, cyan, and black is internally added wherein the difference in work function between the toners is 0.02 eV or more. The toners form a full color image by color superposition on a latent image carrier or color superposition on an intermediate transfer medium or a recording medium such as a paper sheet or a synthetic resin film for overhead projector. The color superposition is started with a toner having the largest work function.

The work function (Φ) is known as energy necessary for taking out electrons from a substance. The smaller the work function of a substance is, it is easier to take out electrons from the substance. The larger the work function of a substance is, it is harder to take out electrons from the substance. Accordingly, when a substance having a small work function and a substance having a large work function are in contact with each other, the substance having a small work function is positively charged and the substance having a large work function is negatively charged. Work function can be numerically indicated as energy (eV) necessary for taking out electrons from the substance and can be used for evaluating the chargeability by contact between unicolor toners made from various materials.

The work function (Φ) is measured by a surface analyzer (AC-2 of low-energy electric computer type, produced by Riken Keiki Co., Ltd.). According to the present invention, in the aforementioned surface analyzer, a heavy hydrogen lump is used, the radiation amount is set to 500 nW, and a monochromatic beam is selected by a spectrograph, and samples are radiated with a spot size of 4 square mm, an energy scanning range of 3.4-6.2 eV, and a measuring time of 10 sec/one point. The quantity of photoelectrons emitted from each sample surface is detected. Work function is measured with repeatability (that is, standard deviation) of 0.02 eV. For ensuring the repeatability of data, the samples to be measured are left for 24 hours at environmental temperature and humidity of 25° C., 55% RH before measurement.

Samples of toner mother particles, external additive particles, metallic soap particles, toner particles, and the like are measured by using a toner-specific measurement cell. FIGS. 1(A) and 1(B) are illustrations for explaining a sample measurement cell used for measuring work functions. As shown in a plan view of FIG. 1(A) and a side view of FIG. 1(B), the sample measurement cell C1 comprises a stainless disk of 13 mm in diameter and 5 mm in height and a sample receiving concavity C2 of 10 mm in diameter and 1 mm in depth formed in the center of the stainless disk. For measurement, sample is put in the concavity of the cell by using a weighting spoon without pressure and then is leveled by using a knife edge. The measurement cell filled with the sample is fixed to a sample stage at a predetermined position. Then, measurement is conducted under conditions that the radiation amount is set to 500 nW, and the spot size is set to 4 square mm, the energy scanning range is set to 4.2-6.2 eV.

Figure 2:
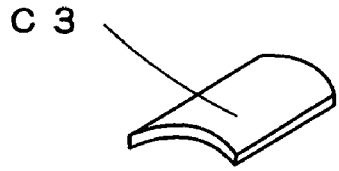
FIGS. 2(A) and 2(B) are illustrations for explaining the method of measuring work functions.
Figure 2:
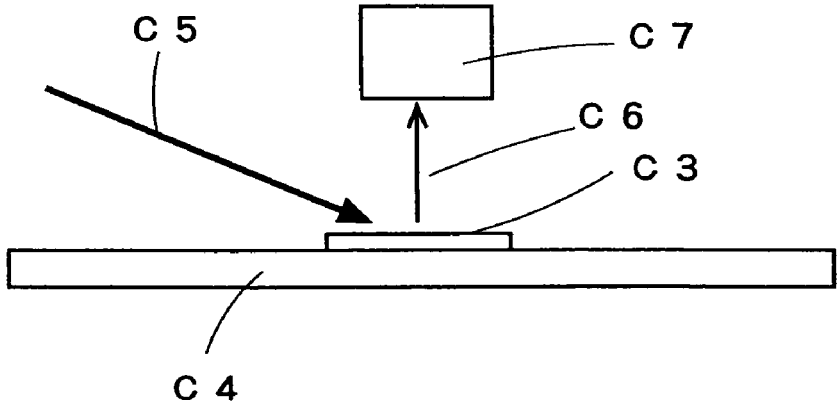

In case that the sample is a cylindrical member such as a latent image carrier, as shown in FIGS. 2(A) and 2(B), the cylindrical member is cut to have a width of 1-1.5 cm and is further cut in the lateral direction along ridge lines so as to obtain a test piece C3 of a shape as shown in FIG. 2(A). After that, the test piece is fixed to the sample stage C4 at the predetermined position in such a manner that a surface to be radiated is parallel to the direction of radiation of measurement light C5 as shown in FIG. 2(B). Accordingly, photoelectron C6 emitted from the test piece can be efficiently detected by a detector C7 i.e. a photomultiplier. In this surface analysis, photoelectron emission is started at a certain energy value (eV) while scanning excitation energy of monochromatic beam from the lower side to the higher side. The energy value is called "work function (eV)". Normalized photoelectron yield which is measured at the same time as work function during the work function measurement indicates a constant gradient when photoelectron yield per unit photon is raised to the "½" power and indicates a state of easily allowing electrons to be emitted.

Toners of the present invention are toners of different colors in which at least hydrophobic silica particles and metallic soap particles are externally added to toner mother particles in which a coloring agent selected from a group consisting of at least yellow, magenta, cyan, and black is internally added. As will be described in the following paragraphs, work functions of coloring agents and external additives may have various values even with the same hue and of the same kind so that the coloring agents and external additives may be selectively used to have a predetermined work function of toner mother particles, toner particles.

The toner mother particles used in the toner may be prepared by the pulverization method or the polymerization method. For making the pulverized toner, a release agent and a charge control agent are added to a resin binder containing at least a pigment, and uniformly mixed by a Henschel mixer, melt and kneaded by a twin-shaft extruder. After cooling process, they are classified through the rough pulverizing-fine pulverizing process. Further, external additives are added, thereby obtaining the toner.

As the binder resin, a synthetic resin used as a toner resin may be used. Preferable examples are homopolymers or copolymers of styrene resins containing styrene or styrene substitute, such as polystyrene, poly-α-methyl styrene, chloropolystyrene, styrene-chlorostyrene copolymers, styrene-propylene copolymers, styrene-butadiene copolymers, styrene-vinyl chloride copolymers, styrene-vinyl acetate copolymers, styrene-maleic acid copolymers, styrene-acrylate ester copolymer, styrene-methacrylate ester copolymers, styrene-acrylate ester-methacrylate ester copolymers, styrene-α-chloracrylic methyl copolymer, styrene-acrylonitrile-acrylate ester copolymers, and styrene-vinyl methyl ether copolymers; polyester resins, epoxy resins, polyurethane modified epoxy resins, silicone modified epoxy resin, vinyl chloride resins, rosin modified maleic acid resins, phenyl resins, polyethylene, polypropylene, ionomer resins, polyurethane resins, silicone resins, ketone resins, ethylene-ethylacrylate copolymers, xylene resins, polyvinyl butyral resins, terpene resins, phenolic resins, and aliphatic or alicyclic hydrocarbon resins. These resins may be used alone or in blended state. Among these resins, styrene-acrylate ester-based resins, styrene-methacrylate ester-based resins, and polyester resins are especially preferable in the present invention. The binder resin preferably has a glass-transition temperature in a range of from 50° C. to 75° C. and a flow softening temperature in a range of from 100° C. to 150° C.

As the coloring agents, coloring agents for toners such as dies and pigments of yellow, magenta, cyan, black may be used to form at least four unicolor toners. These dyes and pigments can be used alone or in blended state.

Examples of coloring agents for black (K) include Carbon Black, Lamp Black, Magnetite, and Titan Black.

Examples of coloring agents for yellow (Y) include Chrome Yellow, Hansa Yellow G, Quinoline Yellow, C.I. Pigment yellow 12, C.I. Pigment yellow 17, C.I. Pigment yellow 97, C.I. Pigment yellow 180, C.I. Solvent yellow 162, and Benzidine Yellow.

Examples of coloring agents for magenta (M) include Quinacridon, C.I. Pigment red 48:1, C.I. Pigment red 122, C.I. Pigment red 57:1, C.I. Pigment red 184, and Rhodamine 6G.

Examples of coloring agents for cyan (C) include Ultramarine Blue, Aniline Blue, Phthalocyanine Blue, Phthalocyanine Green, Chalcone Oil Blue, Rose Bengal, Malachite Green lake, C.I. Pigment blue 5:1, and C.I. Pigment blue 15:3.

As the release agent, a release agent for toner may be used. Specific examples are paraffin wax, micro wax, microcrystalline wax, candelilla wax, carnauba wax, rice wax, montan wax, polyethylene wax, polypropylene wax, oxidized polyethylene wax, and oxidized polypropylene wax. Among these, polyethylene wax, polypropylene wax, carnauba wax, or ester wax is preferably employed.

As the charge control agent, a charge control agent for toner may be used. Specific examples are Oil Black, Oil Black BY, Bontron S-22 and S-34 (available from Orient Chemical Industries, LTD.), metal complex compounds of salicylic acid E-81, E-84 (available from Orient Chemical Industries, LTD.), thioindigo type pigments, sulfonyl amine derivatives of copper phthalocyanine, Spilon Black TRH (available from Hodogaya Chemical Co., Ltd.), calix arene type compounds, organic boron compounds, quaternary ammonium salt compounds containing fluorine, metal complex compounds of monoazo, metal complex compounds of aromatic hydroxyl carboxylic acid, metal complex compounds of aromatic di-carboxylic acid, and polysaccharides. Among these, achromatic or white agents are especially preferable for unicolor toner.

As for component proportion in a pulverized toner, par 100 parts by weight of the binder resin, the coloring agent is in a range form 0.5 to 15 parts by weight, preferably from 1 to 10 parts by weight, the release agent is in a range of from 1 to 10 parts by weight, preferably from 2.5 to 8 parts by weight, and the charge control agent is in a range of from 0.1 to 7 parts by weight, preferably from 0.5 to 5 parts by weight.

In case of the pulverized toner, the toner is preferably spheroidized in order to improve the transfer efficiency. For example, by using a turbo mill (available from Turbo Kogyo co., Ltd.) known as a machine allowing the toner to be pulverized into relatively spherical particles, the degree of circularity may be 0.93 maximum. Alternatively, by using a hot air spheroidizing apparatus (available from Nippon Pneumatic Mfg. Co., Ltd.) for treatment after pulverization, the degree of circularity may be 1.00 maximum. In the present invention, the desirable degree of circularity is set in a range of from 0.94 to 0.98, thereby obtaining excellent transfer efficiency. In case of the degree of circularity smaller than 0.94, it may be impossible to obtain desired transfer efficiency. In case of the degree of circularity more than 0.98, a problem of cleaning property may occur.

A polymerized toner can be obtained by suspension polymerization method, emulsion polymerization method, dispersion polymerization method or the like. In the suspension polymerization method, a monomer compound is prepared by melting or dispersing a polymerizable monomer, a coloring agent, a release agent, and, if necessary, a dye, a polymerization initiator, a cross-linking agent, a charge control agent, and other additive(s). By adding the monomer compound into an aqueous phase containing a suspension stabilizer (water soluble polymer, hard water soluble inorganic material) with stirring, the monomer compound is polymerized and granulated, thereby forming unicolor toner particles having a desired particle size. The coloring agent, the release agent, the charge control agent as the materials used for preparing the polymerized toner may be the same as those of the pulverized toner.

In the emulsion polymerization, a monomer, a release agent and, if necessary, a polymerization initiator, an emulsifier (surface active agent), and the like are dispersed into a water and are polymerized. During the coagulation, a coloring agent, a charge control agent, and electrolyte as a coagulant are added, thereby forming unicolor toner particles having a desired particle size.

As the polymerizable monomer, a known monomer of vinyl series may be used. Examples include: styrene, o-methylstyrene, m-methylstyrene, p-methylstyrene, α-methylstyrene, P-methoxystyrene, p-ethylstyrene, vinyl toluene, 2,4-dimethylstyrene, p-n-butylstyrene, p-phenylstyrene, p-chlorostyrene, di-vinylbenzene, methyl acrylate, ethyl acrylate, propyl acrylate, n-butyl acrylate, isobutyl acrylate, n-octyl acrylate, dodecyl acrylate, hydroxyethyl acrylate, 2-ethyl hexyl acrylate, phenyl acrylate, stearyl acrylate, 2-chloroethyl acrylate, methyl methacrylate, ethyl methacrylate, propyl methacrylate, n-butyl methacrylate, isobutyl methacrylate, n-octyl methacrylate, dodecyl methacrylate, hydroxyethyl methacrylate, 2-ethyl hexyl methacrylate, stearyl methacrylate, phenyl methacrylate, acrylic acid, methacrylic acid, maleic acid, fumaric acid, cinnamic acid, ethylene glycol, propylene glycol, maleic anhydride, phthalic anhydride, ethylene, propylene, butylene, isobutylene, vinyl chloride, vinylidene chloride, vinyl bromide, vinyl fluoride, vinyl acetate, vinyl propylene, acrylonitrile, methacrylonitrile, vinyl methyl ether, vinyl ethyl ether, vinyl ketone, vinyl hexyl ketone, and vinyl naphthalene. Examples of fluorine-containing monomers are 2,2,2-torifluoroethylacrylate, 2,2,3,3-tetrafluoropropylacrylate, vinyliden fluoride, ethylene trifluororide, ethylene tetrafluoride, and trifluoropropyrene. These are available because the fluorine atoms are effective for negative charge control.

Examples of the emulsifier (surface active agent) include dodecyl benzene sulfonic acid sodium, sodium-tetradecyl sulfate, pentadecyl sodium sulfate, sodium octylsulphate, sodium oleate, sodium laurate, potassium stearate, calcium oleate, dodecylammonium chloride, dodecylammonium bromide, dodecyltrimethylammonium bromide, dodecylpyridinium chloride, hexadecyltrimethylammonium bromide, dodecylpolyoxy ethylene ether, hexadecylpolyoxy ethylene ether, laurylpolyoxy ethylene ether, and sorbitan monooleate polyoxy ethylene ether.

Examples of the polymerization initiators include potassium persulfate, sodium persulfate, ammonium persulfate, hydrogen peroxide, 4,4'-azobis-cyano valeric acid, t-butyl hydro peroxide, benzoyl peroxide, and 2,2'-azobis-isobutyronitrile.

Examples of the electrolyte as coagulant include sodium chloride, potassium chloride, lithium chloride, magnesium chloride, calcium chloride, sodium sulfate, potassium sulfate, lithium sulfate, magnesium sulfate, calcium sulfate, zinc sulfate, aluminum sulfate, and iron sulfate.

Description will be made as regard to how to adjust the degree of circularity of the polymerized toner. In the emulsion polymerization method, the degree of circularity can be freely changed by controlling the temperature and time in the coagulating process of secondary particles. The degree of circularity is in a range of from 0.94 to 1.00. The suspension polymerization method enables to make perfect spherical toner particles. The degree of circularity is in a range of from 0.98 to 1.00. By heating the toner particles at a temperature higher than the glass-transition temperature of toner to deform them for adjusting the circularity, the degree of circularity can be freely adjusted in a range of from 0.94 to 0.98.

In both pulverized toner and polymerized toner, the number-mean particle diameter of toner is preferably 9 μm or less, more preferably 8 μm to 4.5 μm. With a toner having a number-mean particle diameter greater than 9 μm, the reproducibility of resolution should be lowered as compared to a toner having small particle diameter when a latent image is formed with high resolution of 1200 dpi or more. As for a toner having a number-mean particle diameter of 4.5 μm or less, the contrast ratio of the toner is lowered and the increase in the amount of external additive is inevitable for improving the fluidity so that there is a tendency to deteriorate the fixing property. Therefore, these toners are unfavorable. In the present invention, the mean particle diameter of toner mother particles and toner particles are values measured by a particle analyzer (FPIA2100 available from Sysmex corporation), that is, a number-mean particle diameter.

The work function of the toner mother particles obtained as mentioned above is in a range of from 5.3 to 5.8 eV.

Now, description will be made as regard to the external additives. The toner mother particles contain, as the external additives, at least hydrophobic silica particles and metallic soap particles.

The hydrophobic silica particles are added for the purpose of applying negative chargeability and fluidity and may be dry-process particles made from silicon halide compound or wet-process particles deposited from silicon compound in liquid. The mean particle diameter of primary particles of the silica particles is preferably from 5 nm to 50 nm, more preferably from 10 nm to 40 nm. Silica particles of which mean particle diameter of primary particles is less than 5 nm is easy to be embedded in toner mother particles and easy to be negatively charged. On the other hand, silica particles of which mean particle diameter of primary particles exceeds 50 nm have deteriorated effect of applying fluidity to toner mother particles, making the uniform negative charging of toner difficult. As a result, there is a tendency to increase the amount of toner particles which are reversely charged i.e. positively charged. The particle diameters of the external additive particles in the present invention are values measured by an electron microscope, indicating number-mean particle diameters.

The hydrophobic silica particles preferably contain silica particles having different number-mean particle diameter distributions. It is preferable that small-diameter silica particles having a number-mean primary particle diameter of from 5 nm to 20 nm, more preferably from 7 nm to 16 nm and large-diameter silica particles having a mean primary particle diameter of form 30 nm to 50 nm, more preferably from 30 nm to 40 nm are used together. The small-diameter silica particles provide the desirable fluidity and desirable negative charging property and the large-diameter silica particles prevent the external additives from being embedded in the toner mother particles.

The amount of the hydrophobic silica particles is from 0.05 to 2 parts by weight per 100 parts by weight of toner mother particles. The amount less than 0.05 parts by weight can not exhibit the effect of applying the fluidity, while the amount exceeding 2 parts by weight lowers the fixing property.

The ratio (weight ratio) of the small-diameter particles and the large-diameter particles is from 5:1 to 1:5. Too much small-diameter particles lowers the fixing property, while too little small-diameter particles lowers the fluidity.

The work functions of hydrophobic silica particles are in a range of from 5.18 eV to 5.24 eV. It is preferable that the work function of hydrophobic silica particle is smaller than that of toner mother particle by at least 0.05 eV or more. Accordingly, charge transfer is caused by the difference in work function, thereby sticking hydrophobic silica particles to toner mother particles.

As another external additive, hydrophobic titanium oxide particles are added for the purpose of applying high fluidity and stable charging characteristics. The hydrophobic titanium oxide particles may be any of rutile type titanium oxide particles, anatase type titanium oxide particles, and rutile/anatase mixed crystal type titanium oxide particles. Preferable are rutile/anatase mixed crystal type titanium oxide particles, for example, rutile type titanium oxide particles containing water-containing titanium oxide and/or anatase type titanium oxide as described in JP-A-2000128534. Such rutile type titanium oxide particles have a spindle shape or disk shape of which major axial diameter is in a range of from 0.02 μm to 0.10 μm and the ratio of the major axial diameter to the minor axial diameter is set to be 2 to 8, wherein when added as external additive to toner mother particles, the rutile type titanium oxide particles are hardly embedded in the toner mother particles because of the shape thereof.

The adding amount of the hydrophobic titanium oxide particles is from 0.05 to 2 parts by weight, preferably from 0.1 to 1.5 parts by weight, per 100 parts by weight of toner mother particles. The amount less than 0.05 parts by weight can not exhibit the effect of applying the stable charging property, while the amount exceeding 2 parts by weight excessively lowers the negative charging amount of toner. In addition, the adding amount of the hydrophobic titanium oxide particles is from 10 to 150 parts by weight per 100 parts by weight of hydrophobic silica particles. The amount less than 10 parts by weight can not exhibit the effect of preventing the excessive charge, while the amount exceeding 150 parts by weight excessively lowers the negative charging amount of toner.

The work functions of the hydrophobic titanium oxide particles are in a range of from 5.5 to 5.7 eV. The hydrophobic titanium oxide particles may be externally added to the toner mother particles at the same time of the hydrophobic silica particles. However, if the work function of toner mother particle and the work function of titanium oxide particle are substantially equal, that is, the difference therebetween is 0.1 eV or less, the hydrophobic titanium oxide particles are preferably externally added at the same time of metallic soap particles as will be described later after the hydrophobic silica particles are first externally added to the toner mother particles.

Hydrophobic titanium oxide particles of which work function is substantially equal to that of toner mother particles are hard to directly adhere to the toner mother particles, but can adhere to the toner mother particles via hydrophobic silica particles having a small work function because of difference in contact potential and therefore facilitate the charge transfer from hydrophobic silica particles which are excessively charged, thereby effectively preventing the excessive charge of hydrophobic silica particles. Therefore, setting the work function of hydrophobic titanium oxide particles to be substantially equal to that of toner mother particles maximizes the charge adjusting function of the hydrophobic titanium oxide particles, this function being the purpose of adding the hydrophobic titanium oxide particles.

Other inorganic and/or organic external additives for toner may be used together. Examples include an external additive containing modified silica particles of which surfaces are modified with hydroxide or oxide of at least one selected from a group consisting of titanium, tin, zirconium, and aluminum wherein the amount of modified silica particles is 1.5 times or less of the amount of silica particles, positively charged silica, alumina, zinc oxide, magnesium fluoride, silicon carbide, boron carbide, titanium carbide, zirconium carbide, boron nitride, titanium nitride, zirconium nitride, zirconium oxide, calcium carbonate, magnetite, molybdenum disulfide, metallic salt titanate such as strontium titanate, silicon metallic salt, and resin fine particles such as acrylic resin, styrene resin, and fluororesin. It is preferable that these external additives are set to have suitable respective work functions in consideration of adhering properties to the toner mother particles as well as the addition purposes.

The entire adding amount of these external additive particles is from 0.1 to 5 parts by weight, preferably from 0.5 to 4.0 parts by weight, relative to 100 parts by weight of toner mother particles. The amount less than 0.1 parts by weight makes the effect of applying the fluidity and charge control insufficient, while the amount exceeding 5 parts by weight lowers the fixing property and loses the balance of charge.

Metallic soap particles to be added as external additive particles are added for the purpose of lowering the number rate of liberation of external additive particles in toner so as to prevent the occurrence of fog, preventing the surface of a photoreceptor being damaged, and improving the transfer efficiency.

Metallic soap particles are particles of a metallic salt selected from a group consisting of zinc, magnesium, calcium, and aluminum of higher fatty acid. Examples include magnesium stearate, calcium stearate, zinc stearate, monoaluminum stearate, and tri-aluminum stearate. The average particle diameter of the metallic soap particles is from 0.5 to 20 μm, preferably from 0.8 to 10 μm.

The adding amount of the metallic soap particles is from 0.05 to 0.5 parts by weight, preferably from 0.1 to 0.3 parts by weight, per 100 parts by weight of toner mother particles. The amount less than 0.05 parts by weight makes the function as lubricant insufficient and makes the function as binder insufficient, while the amount exceeding 0.5 parts by weight increases the possibility of producing fog. The adding amount of the metallic soap particles is from 2 to 10 parts by weight per 100 parts by weight of the external additives such as the hydrophobic silica particles and the hydrophobic titanium oxide particles. The amount less than 2 parts by weight makes the function as lubricant insufficient and makes the function as binder insufficient, while the amount exceeding 10 parts by weight lowers the fluidity and increases the possibility of producing fog.

The work functions of the metallic soap particles are in a range of from 5.3 to 5.8 eV. The work function of metallic soap particles is preferably substantially equal to that of toner mother particles so that the difference therebetween is 0.15 eV or less, more preferably 0.1 eV or less. The metallic soap particles are preferably externally added after the hydrophobic silica particles are externally added to the toner mother particles. The work function of the hydrophobic silica particles is from 5.0 to 5.3 eV so that external additive particles having small work function adhere to the surfaces of the toner mother particles by charge transfer because of difference in work function. Then, the metallic soap particles added in a post-process adhere to external additives near and on the toner mother particles or directly adhere to the toner mother particles. Setting the work function of the metallic soap particles to be substantially equal to that of the toner mother particles enables the maintenance of fluidity and charging property of toner mother particles without impeding properties as functions and effects of inorganic external additives such as an effect of applying fluidity and an effect of applying chargeability.

Addition of metallic soap particles of which work function is substantially equal to that of toner mother particles so that the difference therebetween is 0.15 eV or less enables further reduction in number rate of liberation of external additive particles so as to prevent the occurrence of fog as will be described in the following embodiment. This may be because the charge transfer in external additive particles is not impeded.

By adding metallic soap particles of which work function is substantially equal to that of toner mother particles, the adhesion of the metallic soap particles to the toner mother particles can be reduced, thus facilitating the transition of metallic soap particles from toner particles to the surface of the latent image carrier. Therefore, the generation of blemishes of the surface of the latent image carrier during cleaning is further prevented, thus further improving the transfer efficiency. When the work function of metallic soap particles is smaller than that of the toner mother particles, the metallic soap particles strongly adhere to the toner mother particles, thus making the transition of metallic soap particles to the surface of the latent image carrier harder and disturbing the stable charging property by external additive particles. Therefore, it is unfavorable that the work function of metallic soap particles is smaller than that of the toner mother particles. When the work function of metallic soap particles is larger than that of the toner mother particles, the transition of the metallic soap particles to the toner mother particles is facilitated, but the stable charging property by the external additive particles is disturbed and the larger work function gives rise to a need of setting the work function of the surface of the latent image carrier larger, thus reducing the possibility of design of a photosensitive layer in organic photoreceptor as will be described later.

The metallic soap has a function as adhesives for connecting the toner mother particles and the external additives, thereby preventing the liberation of the external additive particles from the toner mother particles.

The external additive particles in the present invention are preferably processed by a hydrophobic treatment with a silane coupling agent, a titanate coupling agent, a higher fatty acid, or silicone oil. The hydrophobic ratio is 40% or more, preferably 50% or more. Examples of hydrophobic treatment agents are dimethyldichlorosilane, octyltrimethoxysilane, hexamethyldisilazane, silicone oil, octyltrichlorosilane, decyl-trichlorosilane, nonyl-trichlorosilane, (4-iso-propylphenyl)-trichlorosilane, (4-t-butylphenyl)-trichlorosilane, dipentyle-dichlorosilane, dihexyle-dichlorosilane, dioctyle-dichlorosilane, dinonyle-dichlorosilane, didecyle-dichlorosilane, didodecyl-dichlorosilane, (4-t-butylphenyl)-octyl-dichlorosilane, di-decenyl-dichlorosilane, di-nonenyl-dichlorosilane, di-2-ethylhexyl-dichlorosilane, di-3,3-dimehylpentyl-dichlorosilane, trihexyl-chlorosilane, trioctyl-chlorosilane, tridecyl-chlorosilane, dioctyl-methyl-chlorosilane, octyl-dimethyl-chlorosilane, and (4-iso-propylphenyl)-diethyl-chlorosilane.

Measurement examples of work functions of the external additive particles such as hydrophobic silica particles are shown in Table 1.

TABLE 1

| External additive particles | Mean particle diameter (nm) | Work function (eV) | Normalized photoelectron yield |
|---|---|---|---|
| Hydrophobic rutile/anatase type titanium oxide | Miner axis 20<br>Major axis 50-60 | 5.64 | 8.4 |
| Hydrophobic negatively chargeable vapor phase method silica | 7 | 5.18 | 6.1 |
| Hydrophobic negatively chargeable vapor phase method silica | 12 | 5.22 | 5.1 |
| Hydrophobic negatively chargeable vapor phase method silica | 16 | 5.19 | 6.8 |
| Hydrophobic negatively chargeable vapor phase method silica | 40 | 5.24 | 5.2 |
| Vapor phase method alumina | 13 | 5.29 | 5.2 |

Measurement examples of work functions of metallic soap particles are shown in the following Table 2.

TABLE 2

| Metallic soap particles: Manufacturer | Particle diameter (μm) | Abbreviation | Work function (eV) | Normalized photoelectron yield |
|---|---|---|---|---|
| Mono-aluminum stearate: Kanto Kagaku | 5-10 | M1StAl | 5.21 | 1.1 |
| Zinc stearate: Kanto Kagaku | 5-10 | M2StZn | 5.64 | 4.0 |

TABLE 2-continued

| Metallic soap particles: Manufacturer | Particle diameter (μm) | Abbreviation | Work function (eV) | Normalized photoelectron yield |
|---|---|---|---|---|
| Magnesium stearate: Kanto Kagaku | 5-10 | M3StMg | 5.57 | 8.6 |
| Calcium stearate: Kanto Kagaku | 5-11 | M4StCa | 5.49 | 5.1 |
| Magnesium stearate fine particles: NOF Corporation | 1.1 | M5StMg | 5.58 | 7.0 |
| Zinc stearate fine particles: NOF Corporation | 1.0 | M6StZn | 5.36 | 5.6 |
| Calcium stearate fine particles: NOF Corporation | 1.1 | M7StCa | 5.32 | 5.5 |
| Mono-aluminum stearate: NOF Corporation | 5-11 | M8StAl | 5.19 | 1.7 |
| Tri-aluminum stearate: NOF Corporation | 6-11 | M9StAl | 5.17 | 1.9 |

In the method of producing the toner of the present invention, it is preferable that the hydrophobic silica particles are externally added to the toner mother particles and, after that, the metallic soap particles are externally added. The work function of the hydrophobic silica particles is from 5.0 to 5.3 eV and the work function of the toner mother particles is from 5.3 to 5.8 eV. External additive particles of which work function is smaller than that of the toner mother particles adhere to the surfaces of the toner mother particles by charge transfer because of difference in work function. The metallic soap particles are preferably added in a post-process. By adding the metallic soap particles in the post-process, the liberation of hydrophobic silica particles can be prevented, that is, the effect of addition of the metallic soap particles can be exhibited.

When other external additive particles are added as external additive particles, for example, the work function of hydrophobic rutile/anatase type titanium oxide is 5.64 eV and the hydrophobic rutile/anatase type titanium oxide is preferably externally added at the same time of the metallic soap particles. When the work function of external additive particles is substantially equal to that of toner mother particles, the external additive particles are hard to directly adhere to the toner mother particles, but can adhere to the toner mother particles via hydrophobic silica particles having a small work function because of difference in contact potential.

The addition of external additive particles to the toner mother particles is preferably conducted by a Henschel Mixer (available from Mitsui Miike Machinery Co., Ltd.), a Mechanofusion system (available from Hosokawa Micron Corporation), or a Mechanomill (available from Okada Seiko co., Ltd.). In case of using a Henschel Mixer, the mixing is preferably conducted at from 5,000 rpm to 7,000 rpm for one minute to three minutes for the first stage of adding hydrophobic silica particles and the mixing is preferably conducted at from 5,000 rpm to 7,000 rpm for one minute to three minutes for the second stage of adding metallic soap particles.

The work function of toner is preferably from 5.3 to 5.85 eV, more preferably from 5.35 to 5.8 eV. The work function of toner less than 5.3 eV causes a problem of narrowing the selection ranges of available latent image carriers and intermediate transfer media. The work function of toner exceeding 5.85 eV means reduction of colorant content in the toner, thus lowering the coloring property. The work functions of four unicolor toners of yellow, magenta, cyan, and black are set to be different from each other by suitably selecting the kinds of binders, colorants, external additives, and the like composing toner particles so as to adjust the work functions of the obtained toner particles within the aforementioned range. The work functions of the four unicolor toners are preferably different from each other by at least 0.02 eV.

For the color superposition of the four unicolor toners, the work function of the first unicolor toner to be first developed or transferred is preferably set to be the largest work function of from 5.8 to 5.6 eV, the work function of the second unicolor toner to be superposed on the first unicolor toner is preferably set to be from 5.7 to 5.5 eV, the work function of the third unicolor toner to be superposed on the second unicolor toner is preferably set to be from 5.6 to 5.4 eV, and the work function of the fourth unicolor toner to be superposed on the third unicolor toner is preferably set to be the smallest work function of from 5.5 to 5.3 eV so that the work function is set to be smaller the former one.

In particular, the first unicolor toner preferably has a work function of at least 5.6 eV and a normalized photoelectron yield of 6 or more, preferably 8 or more, at measurement light intensity of 500 nW and therefore is excellent in triboelectric charging.

Hereinafter, the first and fourth image forming apparatuses of the present invention will be described with reference to FIGS. 3-6, as of the single-component development type using negatively chargeable toners, but any of the image forming apparatuses can be of the two-component development type.

Figure 3:
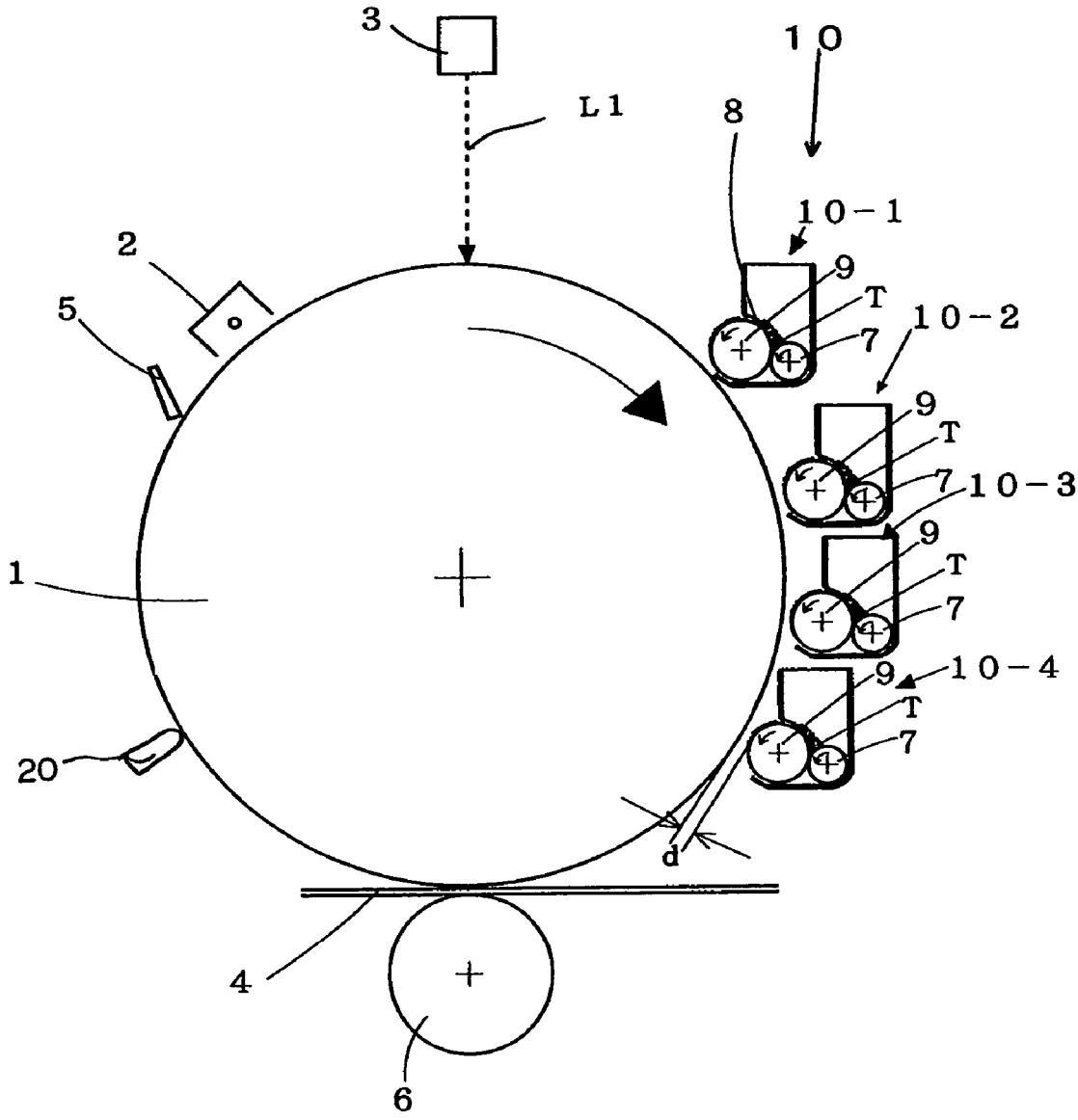
FIG. 3 is an illustration for explaining main parts of a first image forming apparatus of the present invention.
Figure 4:
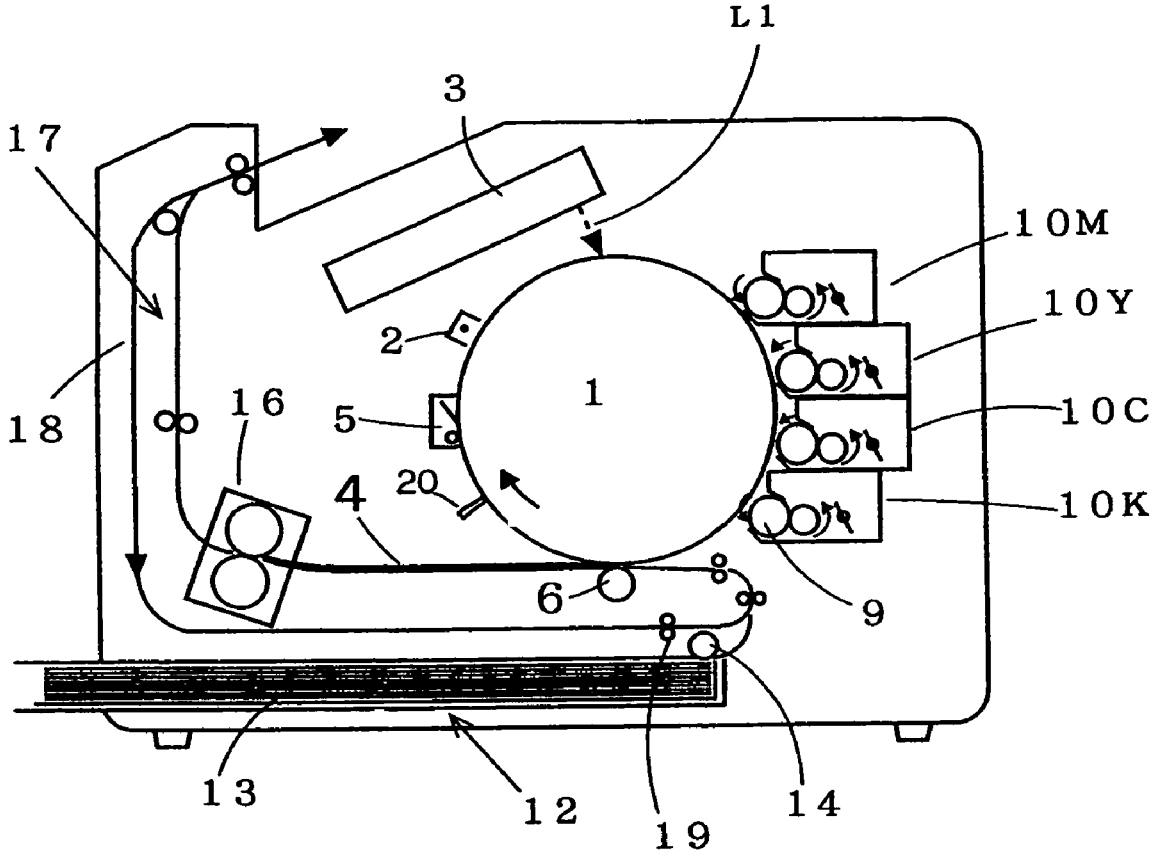
FIG. 4 is an overall view for explaining the first image forming apparatus of the present invention.

The first image forming apparatus comprises a latent image carrier and a plurality of developing devices which are arranged around the latent image carrier and each of which holds a unicolor toner of one of a plurality of colors. In the first color image forming apparatus, an electrostatic latent image is formed on the image carrier and is developed with the toners by the developing devices so as to sequentially superpose unicolors on the latent image carrier, thereby forming a full color toner image. Then, the full color toner image is directly transferred to a recording medium such as a paper sheet or a synthetic resin film for overhead projector at once and is fixed. FIG. 3 shows main parts of this apparatus and FIG. 4 shows an overall view of this apparatus.

In FIG. 3, numeral 1 designates a latent image carrier, numeral 2 designates a charging device, numeral 3 designates an exposure unit, L1 designates selective light corresponding to desired image information outputted from the exposure unit, numeral 4 is a recording medium such s a paper sheet or a synthetic resin film, numeral 5 designates a cleaning blade, numeral 6 designates a transfer roller, numeral 7 designates a toner supply roller, numeral 8 designates a regulating blade, numeral 9 designates a development roller, numerals 10-1 through 10-4 designate developing devices which holed yellow, magenta, cyan, and black toners, respectively and which have work functions different from each other, numeral 20 designates removing light, and d designates a gap.

The developing devices are described as developing devices employing an organic photoreceptor as a latent image carrier. The same is true for other image forming apparatuses.

The organic photoreceptor 1 may be a single-layer photoreceptor or a multilayer photoreceptor. In case of the multilayer photoreceptor, the photoreceptor comprises a charge generation layer and a charge transport layer which are sequentially laminated on a conductive substrate via an undercoat layer.

As the conductive substrate, a known conductive substrate, for example, having conductivity of volume resistance $10^{10}$ Ω·cm or less can be used. Specific examples are a tubular substrate of from 20 mm to 90 mm in diameter formed by machining aluminum alloy, a tubular substrate made of polyethylene terephthalate film which is provided with conductivity by chemical vapor deposition of aluminum or conductive paint, and a tubular substrate of from 20 mm to 90 mm in diameter, belt-like substrate, or a sheet-like substrate formed by conductive polyimide resin. In addition, a seamless metallic belt made of a nickel electrocast tube or a stainless steel tube may be suitably employed.

As the undercoat layer provided on the conductive substrate, a known undercoat layer may be used. For example, the undercoat layer is disposed for improving the adhesive property, preventing moire phenomenon, improving the coating property of the charge generation layer as an upper layer thereof, and/or reducing residual potential during exposure. The resin as material of the undercoat layer preferably has high insoluble property relative to solvent used for a photosensitive layer because the photosensitive layer is formed on the undercoat layer. Examples of available resins are water soluble resins such as polyvinyl alcohol, casein, sodium polyacrylic acid, alcohol soluble resins such as polyvinyl acetate, copolymer nylon, and methoxymethylate nylon, polyurethane, melamine resin, and epoxy resin. The foregoing resins may be used alone or in combination. These resins may contain metallic oxide such as titanium dioxide or zinc oxide.

As the charge generation pigment for use in the charge generation layer, a known material may be used. Specific examples are phthalocyanine pigments such as metallic phthalocyanine, metal-free phthalocyanine, azulenium salt pigments, squaric acid methine pigments, azo pigments having a carbazole skeleton, azo pigments having a triphenylamine skeleton, azo pigments having a diphenylamine skeleton, azo pigments having a dibenzothiophene skeleton, azo pigments having a fluorenone skeleton, azo pigments having an oxadiazole skeleton, azo pigments having a bis-stilbene skeleton, azo pigments having a distyryl oxadiazole skeleton, azo pigments having a distyryl carbazole skeleton, perylene pigments, anthraquinone pigments, polycyclic quinone pigments, quinone imine pigments, diphenylmethane pigments, triphenylmethane pigments, benzoquinone pigments, naphthoquinone pigments, cyanine pigments, azomethine pigments, indigoid pigments, and bisbenzimidazole pigments. The foregoing charge generation pigments may be used alone or in combination.

Examples of the binder resin for use in the charge generation layer include polyvinyl butyral resin, partially acetalized polyvinyl butyral resin, polyarylate resin, and vinyl chloride-vinyl acetate copolymer. As for the structural ratio between the binder resin and the charge generation material, the charge generation material is in a range of from 10 to 1000 parts by weight relative to 100 parts by weight of the binder resin.

As the charge transport material for use in the charge transport layer, known materials may be used and the charge transport material is divided into an electron transport material and a positive hole transport material. Examples of the electron transport material include electron acceptor materials such as chloroanil, tetracyanoethylene, tetracyanoquinodimethane, 2,4,7-trinitro-9-fluorenone, palladiphenoquinone derivatives, benzoquinone derivatives, and naphthoquinone derivatives. These electron transport materials may be used alone or in combination.

Examples of the positive hole transport material include oxazole compounds, oxadiazole compounds, imidazole compounds, triphenylamine compounds, pyrazoline compounds, hydrazone compounds, stilbene compounds, phenazine compounds, benzofuran compounds, buthaziene compounds, benzizine compounds, and derivatives thereof. These electron donor materials may be used alone or in combination.

The charge transport layer may contain antioxidant, age resistor, ultraviolet ray absorbent or the like for preventing deterioration of the aforementioned materials.

Examples of the binder resins for use in the charge transport layer include polyester, polycarbonate, polysulfone, polyarylate, poly-vinyl butyral, poly-methyl methacrylate, poly-vinyl chloride resin, vinyl chloride-vinyl acetate copolymer, and silicone resin. Among these, polycarbonate is preferable in view of the compatibility with the charge transport material, the film strength, the solubility, and the stability as coating material. As for the structural ratio between the binder resin and the charge transport material, the charge transport material is in a range of from 25 to 300 parts by weight relative to 100 parts by weight of the binder resin.

It is preferable to use a coating liquid for forming the charge generation layer and the charge transport layer. Example of solvents for use in the coating liquid include alcohol solvents such as methanol, ethanol, and isopropyl alcohol, ketone solvents such as acetone, methyl ethyl ketone, and cyclohexanone, amide solvents such as N,N-dimethyl horumu amide, and N,N-dimethyl aceto amide, ether solvents such as tetrahydrofuran, dioxane, and ethylene glycol monomethyl ether, ester solvents such as methyl acetate and ethyl acetate, aliphatic halogenated hydrocarbon solvents such as chloroform, methylene chloride, dichloroethylene, carbon tetrachloride, and trichloroethylene, and aromatic solvents such as benzene, toluene, xylene, and monochlor benzene. Selection from the above solvents depends on the kind of used binder resin.

For dispersing the charge generation pigment, it is preferable to disperse and mix by using a mechanical method such as a sand mill method, a ball mill method, an attritor method, a planetary mill method.

Examples of the coating method for the undercoat layer, the charge generation layer and the charge transport layer include a dip coating method, a ring coating method, a spray coating method, a wire bar coating method, a spin coating method, a blade coating method, a roller coating method, and an air knife coating method. After coating, it is preferable to dry them at room temperature and then, heat-dry them at a temperature of from 30 to 200° C. for 30 to 120 minutes.

The thickness of the charge generation layer after being dried is in a range of from 0.05 μm to 10 μm, preferably from 0.1 μm to 3 μm. The thickness of the charge transport layer after being dried is in a range of from 5 μm to 50 μm, preferably from 10 μm to 40 μm.

A single layer type organic photoreceptor is manufactured by forming a single layer organic photosensitive layer including a charge generation material, a charge transport material, a sensitizer, a binder, a solvent, and the like by coating via a similar undercoat layer on a conductive substrate as described in the aforementioned multilayer organic laminated photoreceptor. The negatively chargeable single layer type organic photoreceptor may be made according to the method disclosed in JP-A-2000019746.

Examples of charge generation materials for use in the single layer type organic photosensitive layer are phthalocyanine pigments, azo pigments, quinone pigments, perylene pigments, quinocyanine pigments, indigoid pigments, bisbenzimidazole pigments, and quinacridone pigments. Among these, phthalocyanine pigments and azo pigments are preferable. Examples of charge transport materials are organic positive hole transport compounds such as hydrazone compounds, stilbene compounds, phenylamine compounds, arylamine compounds, diphenyl buthaziene compounds, and oxazole compounds. Examples of the sensitizers are electron attractive organic compounds such as palladiphenoquinone derivatives, naphthoquinone derivatives, and chloroanil, which are also known as electron transport materials. Examples of the binders are thermoplastic resins such as polycarbonate resin, polyarylate resin, and polyester resin.

Proportions of the respective components are the binder: 40-75 parts by weight, the charge generation material: 0.5-20 parts by weight, the charge transport material: 10-50 parts by weight, and the sensitizer: 0.5-30 parts by weight, preferably the binder: 45-65 parts by weight, the charge generation material: 1-20 parts by weight, the charge transport material: 20-40 parts by weight, and the sensitizer: 2-25 parts by weight. The solvent is preferably a solvent being insoluble relative to the undercoat layer. Examples of the solvent are toluene, methyl ethyl ketone, and tetrahydrofuran.

The respective components are pulverized, dispersed, and mixed by using an agitator such as a homo mixer, ball mill, a sand mill, an attritor, a paint conditioner so as to prepare a coating liquid. The coating liquid is applied onto the undercoat layer-according to a dip coating method, a ring coating method, a spray coating method and, after that, is dried to have a thickness of from 15 μm to 40 μm, preferably from 20 μm to 35 μm so as to form the single layer organic photosensitive layer.

In the image forming apparatus of the present invention, the work function ($\Phi_{OPC}$) of the surface of the photoreceptor is larger than the smallest work function ($\Phi_t$) among the work functions of yellow, magenta, cyan, and black toners, preferably a value satisfying $\Phi_{OPC}-\Phi_t<0.07$ eV. As described in the above, the work function of the toner is from 5.3 eV to 5.85 eV, preferably from 5.35 eV to 5.8 eV. If the work function ($\Phi_{OPC}$) of the photoreceptor is smaller than the work function ($\Phi_t$) of the toner having the smallest work function, charge injection from the photoreceptor side occurs between the toner of the first layer among the toners superposed in descending order and the photoreceptor. Therefore, even with applying positive transfer voltage to the back of a recording medium, image force becomes too large for transfer. As a result of this, the transfer field is weakened, thus reducing the transfer efficiency.

The work function of the photoreceptor may be larger than the work function of the toner having the largest work function. In this case, however, the degree of freedom of choices of the photoreceptor's material is deprived. The work function of the photoreceptor is set to be from 5.2 eV to 5.65 eV, preferably from 5.35 eV to 5.6 eV.

The developing devices 10-1 through 10-4 are arranged around the organic photoreceptor 1 along the rotational direction thereof and can swing so that the development roller 9 of only one of these developing devices is selectively brought closer to the photoreceptor 1 keeping a predetermined gap between the development roller 9 and the photoreceptor 1. A single-component non-magnetic toner T is housed in each developing device 10. The toner is supplied to the development roller 9 by a toner supply roller 7 which rotates in the counter-clockwise direction as shown in FIG. 3 and FIG. 4. The development rollers 9 rotate in the counter-clockwise direction as shown in FIG. 3 and FIG. 4 with holding the toners T, supplied by the toner supply rollers 7, on the surfaces thereof so as to carry the toners T to adhere to the organic photoreceptor 1 in the non-contact state with the gap d therebetween, thereby making the electrostatic latent image on the organic photoreceptor 1 visible sequentially.

The development roller 9 may be a roller made of a metallic pipe having a diameter of 16-24 mm, of which surface is treated by plating or blasting or which is formed on its peripheral surface with a conductive elastic layer made of NBR, SBR, EPDM, polyurethane rubber, or silicone rubber to have a volume resistivity of from $10^4$ Ω·cm to $10^8$ Ω·cm and hardness of from 40° to 70° (Asker A hardness). A developing bias voltage is applied to the development roller 9 via the pipe or the center shaft thereof.

The developing gap d is preferably in a range of from 100 μm to 350 μm. As for the developing bias, the voltage of a direct current is preferably in a range of from −200 to −500 V and an alternating current to be superimposed on the direct current is preferably in a range of from 1.5 to 3.5 kHz with a P-P voltage in a range of from 1000 to 1800 V, but not shown. In addition, the peripheral velocity of the development roller which rotates in the counter-clockwise direction is preferably set to have a ratio of peripheral velocity of 1.0 to 2.5, preferably 1.2 to 2.2 relative to that of the organic photoreceptor which rotates in the clockwise direction.

The contact developing method in which the photoreceptor 1 and the development roller 9 are brought in press contact with each other during development may be employed, but not shown. In this case, an elastic development roller is employed as the development roller 9. For example, the development roller 9 may be a roller made of a metallic pipe having a diameter of 16-24 mm, of which surface is treated by plating or blasting or which is formed on its peripheral surface with a conductive elastic layer made of butadiene rubber, styrene-butadiene rubber, ethylene propylene rubber, polyurethane rubber, or silicone rubber to have a volume resistivity of from $10^4$ Ω·cm to $10^8$ Ω·cm and hardness of 40 to 70° (Asker A hardness). A developing bias voltage is applied to the development roller 9 via the shaft of the pipe from a power source (not shown). The developing device may be biased against the organic photoreceptor by a biasing means such as a spring (not shown) with a pressure load of from 19.6 to 98.1 N/m, preferably from 24.5 to 68.6 N/m, to have a nip width of 1 to 3 mm. It should be noted that the pressure load is a pressure load per press width unit length in a direction perpendicular to the nip width in a state that the development roller is pressed against the organic photoreceptor.

The regulating blade 8 is formed by pasting rubber tips on a stainless steel, a phosphor bronze, a rubber plate, or a metal sheet. In case of contact development, a metal sheet may be used without rubber tips. The regulating blade 8 is biased against the development roller by a biasing means such as a spring (not shown) or the bounce itself as an elastic member with a linear load of from 245 to 490 mN/cm to make a toner layer on the development roller thinner.

The amount of carried toner layer to the development device is preferably regulated by the regulating blade to be 0.5 $mg/cm^2$ or less, preferably from 0.3 $mg/cm^2$ to 0.48 $mg/cm^2$ such that the number of stories made up of toner particles in the toner layer is 0.8 to 1.2. When the toner layer is regulated to be thinner, the surface of the toner can be uniformly negatively charged and stable transfer of electrons (charge) is achieved because the unicolor toners are sequentially superposed in descending order of work function, thereby achieving further uniform color superposition.

The amount of developed toner on the latent image carrier is preferably 0.55 $mg/cm^2$ or less, more preferably from 0.4 $mg/cm^2$ to 0.53 $mg/cm^2$. By regulating the developed toner on the latent image carrier into a thin layer, the required primary transfer voltage to be applied to a recording medium can be reduced and the discharge between the recording medium and the latent image carrier at a non-image portion during transfer can be prevented, thus preventing the toner scattering and toner dispersal of the transferred toner image. In addition, since the unicolor toners are sequentially superposed in descending order of work function, the required transfer voltage can be reduced, thereby obtaining a high-quality color toner image.

In preferable relation between the work functions of the regulating blade, the development roller and the work functions of the toners, the respective work functions of the regulating blade and the development roller are set to be smaller than the work functions of the toners, thereby enabling the toner being in contact with the regulating blade or the development roller to be negatively charged and thus achieving further uniform negatively charged toner. The regulation of the charge of toner may be conducted by applying a voltage to the regulating blade 8 so as to cause charge injection to the toner being in contact with the blade.

In the color superposing process of the first image forming apparatus, after the surface of the photoreceptor 1 having a rotating drum shape is uniformly negatively charged by the charging device 2, an electrostatic latent image is formed on the photoreceptor 1 with exposure 3 corresponding to recording information. The electrostatic latent image is reversely developed by the developing device 10-1 holding the toner having the largest work function so as to make a visible image of the first color and the charge is removed by irradiation of removing light 20. In this manner, the developing process for the first color is finished. During this, the cleaning blade 5 and the transfer roller 6 are spaced apart from the photoreceptor.

Then, after the steps of the charging 2 and the exposure 3 again, a visible image of the second color is superposed on the visible image of the first color by the developing device 10-2 holding the toner having the second largest work function and the charge is removed by irradiation of removing light 20. In this manner, the developing process for the second color is finished. By repeating such steps, a visible image of the fourth color is finally superposed on the visible images of the first, second, third colors by the developing device 10-4 holding the toner having the smallest work function, thereby forming a full color image consisting the first, second, third, and fourth colors which are superposed in this order from the photoreceptor side. The formed full color image is transferred from the photoreceptor 1 to the recording medium 4 by the transfer roller 6 at once. After the transfer, residual toner on the photoreceptor 1 is cleaned by the cleaning blade 5. In this manner, the color superposing process is finished.

Since the development order of the toners for sequentially superposing the respective toners of yellow, magenta, cyan, and black on the photoreceptor is the descending order of the work functions of the toners, the transfer of electrons can be achieved between the adjacent toners, that is, from the second toner to the first toner, from the third toner to the second toner, and from the fourth toner to the third toner. As a result of this, electrons can be concentrated to the first toner, whereby the latent image carrier and the toner layer are strongly attracted to each other by electric forces, that is, image forces and electrostatic forces, thereby preventing the scattering of toner particles and color registration error during development for every color.

Since the development order of the toners for sequentially superposing the colors is the descending order of the work functions of the toners, the toners are attracted to each other without being repelled and the charge of the toner superposed on the former toner can be controlled to be smaller than that of the former toner. Therefore, even with different thickness of the toner layer, the reduction in transfer efficiency of the respective unicolor toners is minimized, thereby enabling the transfer to the recording medium with relatively small transfer voltage. Not only the transfer efficiency is improved, but also irregularities in image, defects of transferred colorant, and unevenness in transfer can be prevented and the color reproducibility is improved.

In the image forming apparatus of FIG. 3, the recording medium 4 such as a paper sheet or a synthetic resin film is fed between the organic photoreceptor 1 and the transfer roller 6 functioning as both a back-up roller and a transfer roller. The transfer roller 6 is provided for transferring the developed toner image to the recording medium in a state that the recording medium is in press contact with the photoreceptor.

The transfer roller 6 has a structure comprising a metallic shaft having a diameter of 10-20 mm, an elastic layer, conductive layer, and a resistive outer layer which are laminated on the periphery of the metallic shaft. As the resistive outer layer, a resistive sheet in which conductive fine particles such as conductive carbon are dispersed into a resin such as fuluorocarbon resin or polyvinyl butyral or a rubber such as polyurethane can be employed. The resistive outer layer preferably has a smooth surface, a volume resistivity of from $10^7$ Ω·cm to $10^{11}$ Ω·cm, more preferably from $10^8$ Ω·cm to $10^{10}$ Ω·cm, and a thickness of from 0.02 mm to 2 mm.

The conductive layer is preferably selected from conductive resins in which conductive fine particles such as conductive carbon are dispersed in polyester resin or the like, metallic sheets, or conductive adhesives. The conductive layer has a volume resistivity of $10^5$ Ω·cm or less. When the transfer roller is used to be in press contact with the organic photoreceptor, the elastic layer is required to flexibly deform during the press contact and to quickly return to the original shape after the release of the press contact and is made of an elastic material such as foamed rubber sponge. The foam structure may be continuous-cell foam structure or closedcell foam structure. The elastic layer preferably has rubber hardness (Asker C hardness) of 30-80 and a thickness of 1-5 mm. Because of the elastic deformation of the transfer roller, the organic photoreceptor and the recording medium can be in close contact with each other to have a wider nip width.

It is preferable that a transfer voltage from +200 V to +600 V having a polarity opposite to the polarity of the charging voltage of the toners is applied to the transfer roller. The pressing load of the recording medium on the photoreceptor 1 by the transfer roller 6 is preferably in a range of from 18 to 45 N/m, preferably from 26 to 38 N/m, thereby ensuring the contact between toner particles and the organic photoreceptor so as to further ensure the negative charging of the toner particles and therefore improving the transfer efficiency.

After transferring toner particles from the photoreceptor to the recording medium, the electrostatic charge on the photoreceptor is removed by an erase lump 20 and residual toner on the photoreceptor 1 is cleaned by the cleaning blade 5.

FIG. 4 is an overall view of the first image forming apparatus. The recording medium 4 such as a paper sheet is fed from a sheet cassette 13 of a sheet feeder 12 by a pickup roller 14 at a proper time. Then, color-superposed image formed on the photoreceptor is transferred to the recording medium 4 at once with applied transfer voltage by the transfer roller 6 which is disposed to face the photoreceptor 1 and which can swing relative to the photoreceptor 1.

The transferred image is fused and thus softened by a fixing device 16 and is fixed to the recording medium. In this manner, the image is formed and the recording medium with this image is discharged onto a discharge tray 17. In the image forming apparatus, the discharge path has a switch-back path 18 through which a sheet passing through the discharge path is returned and fed again through a return roller 19 to the transfer roller 6 in case of forming images on both sides of the sheet.

Figure 5:
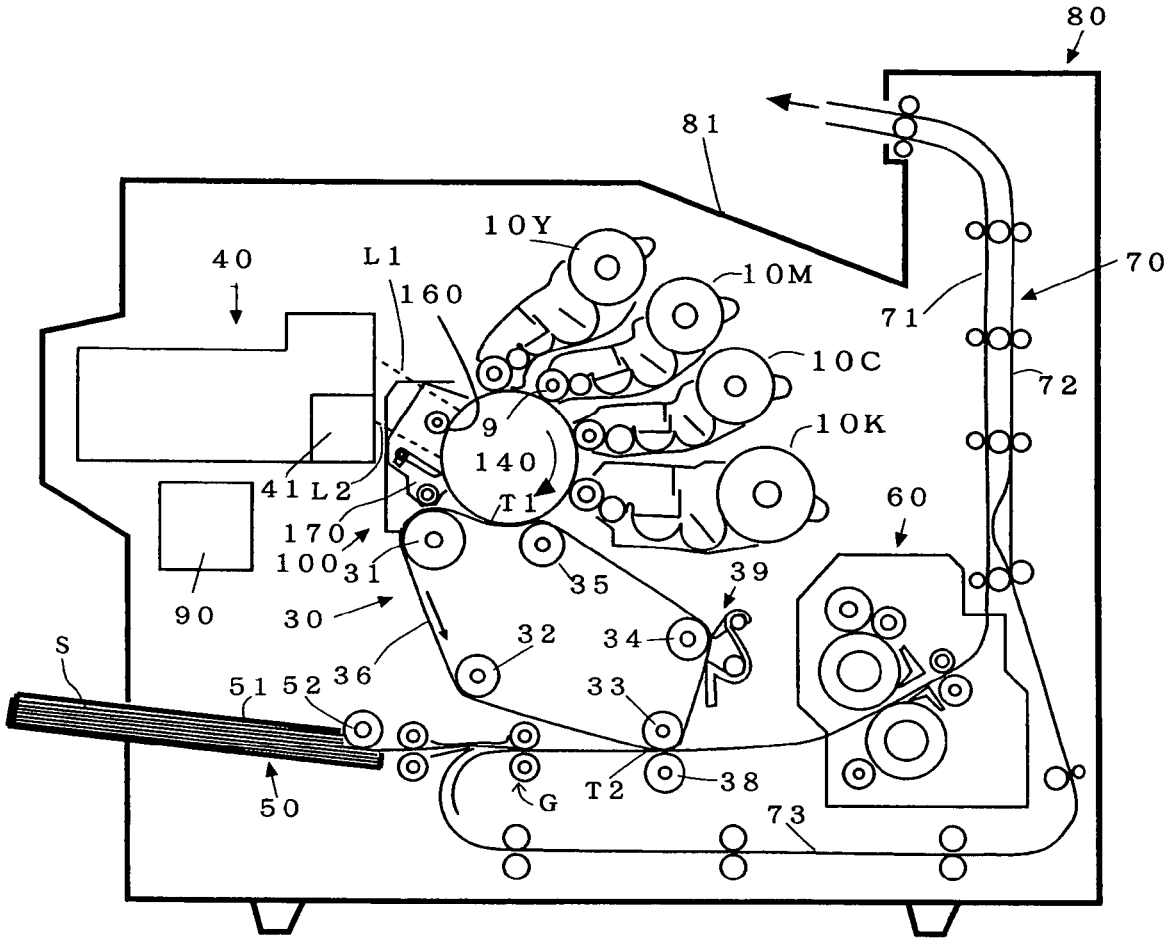
FIG. 5 is an illustration for explaining a second image forming apparatus of the present invention.

FIG. 5 is an illustration for explaining a second image forming apparatus (four cycle color printer) comprising a latent image carrier and a plurality of developing devices which are arranged around the latent image carrier and each of which holds a different unicolor toner. In this apparatus, electrostatic latent images are formed on the latent image carrier and are sequentially developed with the respective unicolor toners on the latent image carrier, thereby forming a full color toner image on the latent image carrier. Then, the full color toner image is transferred to a recording medium via the intermediate transfer medium and is fixed.

In the second image forming apparatus, the steps until a full color toner image is formed by color superposition on the latent image carrier are the same as the first image forming apparatus. The image forming process is different from that of the first image forming apparatus in which the full color toner image is transferred to the recording medium via the intermediate transfer medium and then fixed.

The intermediate transfer medium may be a transfer drum or a transfer belt. The transfer belt may be categorized into two types using substrates made of materials different from each other. One is a type comprising a film or a seamless belt made of resin having a transfer layer as an outer layer thereof and the other is a type comprising a substrate of elastic member having a transfer layer as an outer layer thereof.

The transfer drum may be also categorized into two types using substrates made of materials different from each other. One is a type corresponding to the photoreceptor comprising a rigid drum, for example a drum made of aluminum, and an organic photosensitive layer formed on the drum. That is, the transfer medium of this type comprising a rigid drum substrate made of aluminum or the like and a transfer layer as an elastic outer layer formed on the drum substrate. The other is a type corresponding to the photoreceptor, a so-called "elastic photoreceptor", i.e. comprising a belt-like substrate or an elastic substrate made of rubber and a photosensitive layer formed on the substrate. That is, the transfer medium of this type comprising a rigid drum substrate made of aluminum or the like and a transfer layer as an outer layer disposed directly or via a conductive intermediate layer on the drum substrate.

As the substrate, a known conductive or insulating substrate may be used. In case of the transfer belt, the volume resistivity is in a range of from $10^4$ Ω·cm to $10^{12}$ Ω·cm, preferably $10^6$ Ω·cm to $10^{11}$ Ω·cm. There are following two kinds according to the kind of substrate.

As for the material and the method for forming a film or a seamless belt, a material prepared by dispersing a conductive material such as conductive carbon black, conductive titanium oxide, conductive tin oxide, or conductive silica into an engineering plastic such as modified polyimide, thermosetting polyimide, polycarbonate, ethylene tetrafluoroethylene copolymer, poly vinylidene fluoride, or nylon alloy is extruded into a semi-conductive film substrate having a thickness of 50-500 μm and is made to be seamless substrate. Further, a surface protective layer for reducing the surface energy and preventing filming of toner is formed on the outer surface by coating fluorine to have a thickness of 5 μm to 50 μm. In this manner, the seamless belt is formed. The coating method may be a dip coating method, a ring coating method, a spray coating method, or another coating method. To prevent cracking at edges and elongation and serpentine motion of the transfer belt, tapes of PET film having a thickness of 80 μm or ribs of polyurethane rubber are attached to the edges of the transfer belt.

In case of the substrate made of a film sheet, the ends of the film sheet are ultrasonic-welded so as to form a belt. As concretely described, a conductive layer and an outer layer are formed on a sheet film before the ultrasonic welding so as to form a transfer belt having desired characteristics. More concretely, in case of using a polyethylene terephthalate film having a thickness of from 60 μm to 150 μm as an insulating substrate, aluminum is deposited on the surface of the film, an intermediate conductive layer composed of a conductive material such as carbon black and resin is further coated if necessary, and a semi-conductive outer layer made of polyurethane resin, fluororesin, conductive material, fluorine fine particles having a surface resistivity higher than that of the intermediate layer is formed, thereby forming the transfer belt. In case that a resistance layer which does not need a large amount of heat for drying is allowed to be formed, the resistance layer may be formed after the ultrasonic welding of the film with aluminum deposition.

As for the material and the method for forming an elastic substrate of rubber or the like, a material prepared by dispersing the aforementioned conductive material into silicone rubber, polyurethane rubber, NBR (nitrile rubber), or EPDM (ethylene propylene rubber) is extruded into a semi-conductive rubber belt having a thickness of from 0.8 mm to 2.0 mm. After that, the surface of the belt is processed by an abrasive such as a sand paper or a polisher to have desired surface roughness. Though this can be used without any additional layer, a surface protective layer may be further formed thereon similarly to the above case.

In case of transfer drum, the transfer drum preferably has a volume resistivity of from $10^4$Ω·cm to $10^{12}$Ω·cm, preferably from $10^7$ Ω·cm to $10^{11}$ Ω·cm. As the method of forming a transfer drum, a conductive elastic substrate is prepared by forming a conductive intermediate layer of an elastic material on a metallic cylinder made of aluminum or the like. Further, a semi-conductive surface protective layer for reducing the surface energy and preventing filming of toner is made by, for example, coating fluorine compound to have a thickness of from 5 μm to 50 μm.

As the method for forming a conductive elastic substrate, a conductive rubber material is prepared by mixing, kneading, and dispersing a conductive material such as carbon black, conductive titanium oxide, conductive tin oxide, or conductive silica into a rubber material such as silicone rubber, polyurethane rubber, NBR (nitrile rubber), or EPDM (ethylene propylene rubber), butadiene rubber, styrene-butadiene rubber, isoprene rubber, chloroprene rubber, butyl rubber, epichlorohydrin rubber, or fluororubber. The conductive rubber material is vulcanized onto an aluminum cylinder having a diameter of from 90 mm to 180 mm and then ground to have a thickness of from 0.8 mm to 6 mm and a volume resistivity of from $10^4$ Ω·cm to $10^{10}$ Ω·cm.

After that, a semi-conductive outer layer made of polyurethane resin, fluororesin, conductive material, and fluorine fine particles is formed to have a thickness of 15-40 μm, thereby forming a transfer drum having a desired volume resistivity of $10^7$ Ω·cm to $10^{11}$ Ω·cm. At this point, the surface roughness is preferably 1 μmRa or less. As an alternative method, a semi-conductive tube made of fluororesin or the like is covered onto a conductive elastic substrate formed in the same manner as described above and is shrank by heat, thereby forming a transfer drum having a desired outer layer and a desired electrical resistivity.

In case that the intermediate transfer medium is a transfer drum or a transfer belt, voltage to be applied as a primary transfer voltage to the conductive layer of the intermediate transfer medium is preferably in a range from +250 V to +600 V. Voltage as a secondary transfer voltage to be applied for conducting the secondary transfer to the receiving medium such as a paper sheet is preferably in a range from +400 V to +2800 V.

Also in the second image forming apparatus, similarly to the first image forming apparatus, since the development order of the toners for sequentially superposing the respective toners of yellow, magenta, cyan, and black on the photoreceptor is the descending order of the work functions of the toners, the transfer of electrons can be achieved between the adjacent toners, that is, from the second toner to the first toner, from the third toner to the second toner, and from the fourth toner to the third toner. As a result of this, electrons can be concentrated to the first toner, whereby the latent image carrier and the toner layer are strongly attracted to each other by electric forces, that is, image forces and electrostatic forces, thereby preventing the scattering of toner particles and color registration error during development for every color.

In addition, since the development order of the toners for sequentially superposing the colors is the descending order of the work functions of the toners, the toners are attracted to each other without being repelled and the charge of the toner superposed on the former toner can be controlled to be smaller than that of the former toner. Therefore, even with different thickness of the toner layer, the reduction in transfer efficiency of the respective unicolor toners is minimized, thereby enabling the transfer to the recording medium with relatively small transfer voltage. Not only the transfer efficiency is improved, but also irregularities in image, defects of transferred colorant, and unevenness in transfer can be prevented and the color reproducibility is improved.

The image forming apparatus shown in FIG. 5 will be described. The image forming apparatus is of a type employing the contact development process in the following description, the apparatus may be of a type employing the non-contact development process. In FIG. 5, a numeral 100 designates a latent image carrier cartridge in which a latent image carrier unit is assembled. In this example, the photoreceptor cartridge is provided so that the photoreceptor and developing units can be separately installed. A latent image carrier 140 comprising a photoreceptor is rotated in a direction of arrow by a suitable driving means (not shown). Arranged around the photoreceptor 140 along the rotational direction are a charging roller 160 as the charging means, developing devices 10M, 10Y, 10C, and 10K, an intermediate transfer device 30, and a cleaning means 170. The developing devices are arranged such that the larger the work function of toner is, the earlier the toner is used for development.

The charging roller 160 is in contact with the outer surface of the photoreceptor 140 to uniformly charge the outer surface of the same. The uniformly charged outer surface of the photoreceptor 140 is exposed to selective light L1 corresponding to desired image information by an exposing unit 40, thereby forming an electrostatic latent image on the photoreceptor 140. The electrostatic latent image is developed with developers by the developing devices 10M, 10Y, 10C, and 10K.

The developing devices are a developing device 10M for magenta, a developing device 10Y for yellow, a developing device 10C for cyan, and a developing device 10K for black. These are arranged such that toner images are superposed in descending order of the work functions.

These developing devices 10M, 10Y, 10C, and 10K can swing so that the development roller 9 of only one of the developing devices is selectively in press contact with the photoreceptor 140. These developing devices hold negatively charged toners on the respective development rollers. Each developing device supplies either one of toners of magenta M, yellow Y, cyan C, and black K to the surface of the photoreceptor 140, thereby developing the electrostatic latent image on the photoreceptor 140.

Each development roller 9 is composed of a hard roller, for example a metallic roller which is processed to have rough surface. The developed toner image is transferred to an intermediate transfer belt 36 of the intermediate transfer device 30. The cleaning means 170 comprises a cleaner blade for scraping off toner particles T adhering to the outer surface of the photoreceptor 140 after the transfer and a toner receiving portion for receiving the toner particles scrapped by the cleaner blade.

The intermediate transfer device 30 comprises a driving roller 31, four driven rollers 32, 33, 34, 35, and the endless intermediate transfer belt 36 laid around these rollers with some tension. The driving roller 31 has a gear (not shown) fixed at the end thereof and the gear is meshed with a driving gear of the photoreceptor 140 so that the driving roller 31 is rotated at substantially the same peripheral velocity as the photoreceptor 140. As a result, the intermediate transfer belt 36 is driven to circulate at substantially the same peripheral velocity as the photoreceptor 140 in the direction of arrow in FIG. 5.

The shiftable driven roller 35 is disposed at such a position that the intermediate transfer belt 36 is in press contact with the photoreceptor 140 by the tension itself between the driving roller 31 and the driven roller 35, thereby providing a primary transfer portion T1 at the press contact portion between the photoreceptor 140 and the intermediate transfer belt 36. The driven roller 35 is disposed near the primary transfer portion T1 on the upstream side in the circulating direction of the intermediate transfer belt.

On the driving roller 31, an electrode roller (not shown) is disposed via the intermediate transfer belt 36. A primary transfer voltage is applied to a conductive layer of the intermediate transfer belt 36 via the electrode roller. The driven roller 32 is a tension roller for biasing the intermediate transfer belt 36 in the tensioning direction by a biasing means (not shown). The driven roller 33 is a backup roller for providing a secondary transfer portion T2. A secondary transfer roller 38 is disposed to confront the backup roller 33 via the intermediate transfer belt 36. A secondary transfer voltage is applied to the secondary transfer roller. The secondary transfer roller can move apart from or to come in contact with the intermediate transfer belt 36 by a sifting mechanism (not shown). The driven roller 34 is a backup roller for a belt cleaner 39. The belt cleaner 39 can move apart from or to come in contact with the intermediate transfer belt 36 by a shifting mechanism (not shown).

The intermediate transfer belt 36 is a dual-layer belt comprising the conductive layer and a resistive layer formed on the conductive layer, the resistive layer being brought in press contact with the photoreceptor 140. The conductive layer is formed on an insulating substrate made of synthetic resin. The primary transfer voltage is applied to the conductive layer through the electrode roller as mentioned above. The resistive layer is removed in a band shape along the side edge of the belt so that the corresponding portion of the conductive layer is exposed in the band shape. The electrode roller is arranged in contact with the exposed portion of the conductive layer.

In the circulating movement of the intermediate transfer belt 36, the toner image formed on the photoreceptor 140 by superposing the plural unicolor toners is transferred onto the intermediate transfer belt 36 at the primary transfer portion T1 at once, the toner image transferred on the intermediate transfer belt 36 is further transferred to a recording medium S such as a paper sheet supplied between the secondary transfer roller 38 and the intermediate transfer belt at the secondary transfer portion T2. The sheet S is fed from a sheet feeder 50 and is supplied to the secondary transfer portion T2 at a predetermined timing by a pair of gate rollers G. Numeral 51 designates a sheet cassette and 52 designates a pickup roller.

The toner image is fixed at the fixing device 60 and is discharged through a discharge path 70 onto a sheet tray 81 formed on a casing 80 of the apparatus body. The image forming apparatus of this example has two separate discharge paths 71, 72 as the discharge path 70. The sheet after the fixing device 60 is discharged through either one of the discharge paths 71, 72. The discharge paths 71, 72 have a switchback path through which a sheet passing through the discharge path 71 or 72 is returned and fed again through a return roller 73 to the secondary transfer portion T2 in case of forming images on both sides of the sheet.

The actions of the second image forming apparatus as a whole will be summarized as follows:

(1) As image information is inputted into a control unit 90 of the image forming apparatus from a personal computer (not shown) or the like, the photoreceptor 140, the respective rollers 9 of the developing devices 10M, 10Y, 10C, 10K, and the intermediate transfer belt 36 are driven to rotate.

(2) The outer surface of the photoreceptor 140 is uniformly charged by the charging roller 160.

(3) The uniformly charged outer surface of the photoreceptor 140 is exposed to selective light L1 corresponding to image information for the first color of which toner has the largest work function, e.g. magenta, by the exposure unit 40, thereby forming an electrostatic latent image for magenta.

(4) Only the development roller of the developing device 10M for magenta as the first color is brought in contact with the photoreceptor 140 so as to develop the aforementioned electrostatic latent image, thereby forming a toner image of magenta as the first color on the photoreceptor 140.

(5) Then, a plurality of toner images are sequentially superposed in descending order of the work functions of the toners.

(6) After all of the toner images are formed on the photoreceptor, a primary transfer voltage of the polarity opposite to the polarity of the toners is applied to the intermediate transfer belt 36, thereby transferring the toner images formed on the photoreceptor 140 at once onto the intermediate transfer belt 36 at the primary transfer portion T1. At this point, the secondary transfer roller 38 and the belt cleaner 39 are kept away from the intermediate transfer belt 36.

(7) After residual toner particles remaining on the photoreceptor 140 are removed by the cleaning means 170, the charge on the photoreceptor 140 is removed by removing light L2 from a removing means 41.

(8) A sheet S is fed from the sheet feeder 50 at a predetermined timing, the toner image, that is, a full color image formed by superposing the four color toner images, on the intermediate transfer belt 36 is transferred onto the sheet with the secondary transfer roller 38 immediately before or after an end of the sheet S reaches the secondary transfer portion T2, namely, at a timing as to transfer the toner image on the intermediate transfer belt 36 onto a desired position of the sheet S. The belt cleaner 39 is brought in contact with the intermediate transfer belt 36 to remove toner particles remaining on the intermediate transfer belt 36 after the secondary transfer.

(9) The sheet S passes through the fixing device 60 whereby the toner image on the sheet S is fixed. After that, the sheet S is carried toward the sheet tray 81 in case of single-side printing, or toward the return roller 73 via the switchback path 71 or 72 in case of dual-side printing.

A third image forming apparatus of the present invention comprises a latent image carrier and a plurality of developing devices holding toners of different colors, respectively, wherein electrostatic latent images are formed on the latent image carrier and are developed by the corresponding developing devices, and the developed toner images are subsequently transferred to the intermediate transfer medium to superpose the colors on the intermediate transfer medium, thereby forming a full color toner image. The full color toner image is transferred to a recording medium at once and is fixed.

The third image forming apparatus of the present invention is the same as the aforementioned second image forming apparatus (four-cycle color printer) shown in FIG. 5 except that toner images for the respective colors are formed on the latent image carrier and a full color toner image is formed by color superposition on the intermediate transfer medium. The different point will be described.

A developing device 10M for magenta, a developing device 10Y for yellow, a developing device 10C for cyan, and a developing device 10K for black are provided as the developing devices for developing electrostatic latent images on the photoreceptor 140. In the third image forming apparatus of the present invention, a toner image developed with a first unicolor toner having the largest work function is transferred to an intermediate transfer belt 36. After the first unicolor toner image is transferred to the intermediate transfer belt, the charge on the photoreceptor is removed by removing light and residual toner particles on the outer periphery of the photoreceptor is cleaned by cleaning means 170. Then, after the steps of the charging and the exposure again, an electrostatic latent image on the photoreceptor is developed with the second unicolor toner having the second largest work function and is transferred to the intermediate transfer belt 36 such that the second unicolor toner image is superposed on the first unicolor toner image on the intermediate transfer belt 36. By repeating such steps, a full color toner image is formed on the intermediate transfer belt by superposing the first unicolor toner, the second unicolor toner, the third unicolor toner, and the fourth unicolor toner in this order from the belt side.

The formed full color toner image obtained on the intermediate transfer belt is transferred to a recording medium such as a paper sheet or a film for overhead projector at once, similarly to the second image forming apparatus.

A fourth image forming apparatus of the present invention comprises toner image forming means each of which is provided for each of a plurality of different unicolor toner. Each toner image forming means comprises a latent image carrier and a developing device holding a toner wherein electrostatic latent images are formed on the latent image carriers and are developed by the developing devices, respectively, and the toner images of the respective colors on the respective latent image carriers are sequentially transferred to an intermediate transfer medium so that a full color toner image is formed by color superposition on the intermediate transfer medium. Then, the full color toner image is transferred to a recording medium at once and is fixed.

Figure 6:
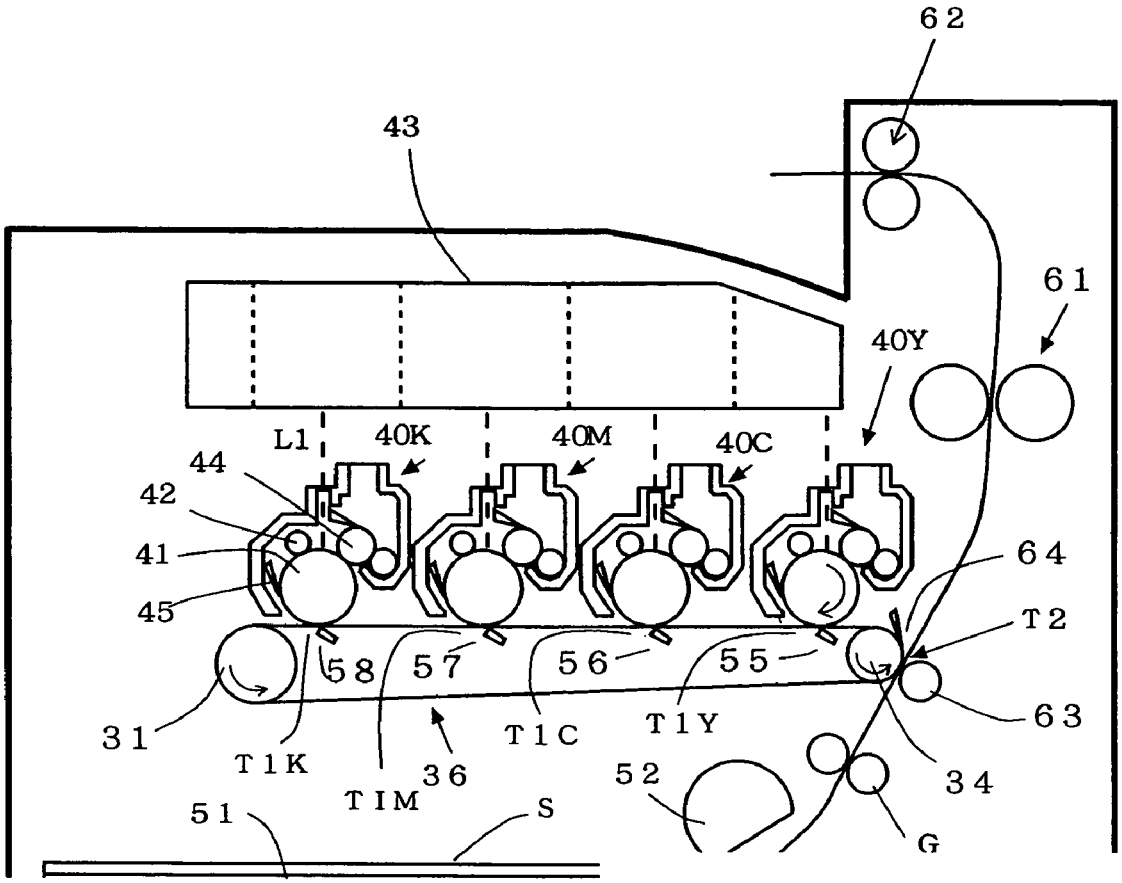
FIG. 6 is an illustration for explaining a fourth image forming apparatus of the present invention.

A schematic front view of the fourth image forming apparatus (a full color printer of the tandem type) of the present invention is shown in FIG. 6. In this case, the photoreceptor and the developing unit are combined in one unit, that is, can be installed as a process cartridge to the apparatus. The apparatus may be of a type employing the contact development process or of a type employing the non-contact development process.

The image forming apparatus comprises an intermediate transfer belt 36 which is laid around only two rollers, i.e. a driving roller 31 and a driven roller 34, with some tension and is driven to circulate in a direction of arrow (the counter-clockwise direction), and four unicolor toner image forming means 40Y, 40C, 40M, and 40K arranged along the intermediate transfer belt 36. Respective toner images formed by the unicolor toner image forming means 40Y, 40C, 40M, and 40K are sequentially primarily transferred to the intermediate transfer belt 36 by transfer means 55, 56, 57, 58, respectively. The respective primary transfer portions are indicated with T1Y, T1C, T1M, and T1K.

As the unicolor toner image forming means, there are 40Y for yellow, 40M for magenta, 40C for cyan, and 40K for black. Each of these unicolor toner image forming means 40Y, 40C, 40M, and 40K comprises a photoreceptor 41 having a photosensitive layer on its outer surface, a charging roller 42 as charging means for uniformly charging the outer surface of the photoreceptor 41, an exposure means 43 for selectively exposing the outer surface of the photoreceptor 41, uniformly charged by the charging roller 42, so as to form an electrostatic latent image, a development roller 44 as development means for developing the electrostatic latent image, formed by the exposure means 43, with developer or toner so as to form a visible image i.e. a toner image, and a cleaning blade 45 as cleaning means for removing toner particles remaining on the surface of the photoreceptor 41 after the toner image developed by the development roller 44 is transferred to the intermediate transfer belt 36 as the primary transfer medium.

These unicolor toner image forming means 40Y, 40C, 40M, and 40K are arranged on a loose side of the intermediate transfer belt 36. Toner images are sequentially transferred to the intermediate transfer belt 36 and sequentially superposed on each other on the intermediate transfer belt 36 so as to form a full color toner image. The full color toner image is secondarily transferred to a recording medium S such as a paper sheet at a secondary transfer portion T2 and is fixed on the recording medium S by passing between a pair of fixing rollers 61. After that, the recording medium S is discharged by a pair of discharge rollers 62 to a predetermine location, that is, an output sheet tray (not shown). Numeral 51 designates a sheet cassette for holding recording media S in a piled state, 52 designates a pickup roller for feeding the recording media S one by one from the sheet cassette 51, G designates a pair of gate rollers for defining the feeding timing of the recording medium S to the secondary transfer portion T2.

Numeral 63 designate a secondary transfer roller as secondary transfer means for cooperating with the intermediate transfer belt 36 to provide the secondary transfer portion T2 therebetween, and 64 designates a cleaning blade as cleaning means for removing toner particles remaining on the surface of the intermediate transfer belt 36 after the secondary transfer. The cleaning blade 64 is in contact with the intermediate transfer belt 36 at a wrapping portion of the intermediate transfer belt 36 around the driving roller 31 not the driven roller 34.

In the fourth image forming apparatus of the present invention, electrostatic latent images on the respective photoreceptors are developed with toners in the unicolor toner image forming means 40Y, 40C, 40M, and 40K wherein the respective toners have different work functions. After a toner image developed by the unicolor toner image forming means holding the first unicolor toner having the largest work function is transferred to the intermediate transfer belt 36, a toner image developed by the unicolor toner image forming means holding the second unicolor toner having the second largest work function is transferred to the intermediate transfer belt 36 and is thus superposed on the first unicolor toner image. By repeating such steps, a full color toner image is formed on the intermediate transfer belt by superposing the first unicolor toner, the second unicolor toner, the third unicolor toner, and the fourth unicolor toner colors in this order from the belt side.

In the third and fourth image forming apparatuses of the present invention, the color superposition is conducted on the intermediate transfer medium. Since the respective toners of yellow, magenta, cyan, and black are sequentially transferred to the intermediate transfer medium and superposed on each other in the descending order of the work functions of the toners, the transfer of electrons can be achieved between the adjacent toners, that is, from the second toner to the first toner, from the third toner to the second toner, and from the fourth toner to the third toner. As a result of this, electrons can be concentrated to the first toner, whereby the intermediate transfer medium and the toner layer are strongly attracted to each other by electric forces, that is, image forces and electrostatic forces, thereby preventing the scattering of toner particles and color registration error during transfer for every color.

Since unicolor toner images are sequentially transferred to the intermediate transfer medium and superposed in the descending order of the work functions of the toners, the toners are attracted to each other without being repelled and the charge of the toner superposed on the former toner can be controlled to be smaller than that of the former toner. Therefore, even with different thickness of the toner layer, the reduction in transfer efficiency of the respective unicolor toners is minimized, thereby enabling the transfer to the intermediate recording medium with relatively small transfer voltage. Not only the transfer efficiency is improved, but also irregularities in image, defects of transferred colorant, and unevenness in transfer can be prevented and the color reproducibility is improved.

The image forming methods mentioned above are a method in which toner images are transferred to a recording medium at once after the development on an electrostatic latent image carrier and a method in which images primarily transferred to the intermediate transfer medium is secondarily transferred to a recording medium at once. The method in which developed images are directly transferred to a recording medium such as a paper sheet eliminates the needs of the intermediate transfer mechanism including a transfer medium and therefore can provide an apparatus having a simple structure and a smaller size.

In case that a plurality of latent image carriers for forming images of different colors are arranged in parallel so that the images are sequentially developed and a color toner image is formed on a recording medium, toner image forming means including the latent image carriers are arranged in descending order of work function of toners from the upstream side in the traveling direction of a feeding belt and a color image is formed through the developing process, the transferring process, and the fixing process on the recording medium. Therefore, the toner previously transferred to the recording medium can be prevented from being reversely transferred to the photoreceptor of the next toner image forming means and the adhesion between toner layers can be improved, thereby forming a color image in which color registration error is prevented and which is excellent in color reproducibility.

Figure 7:
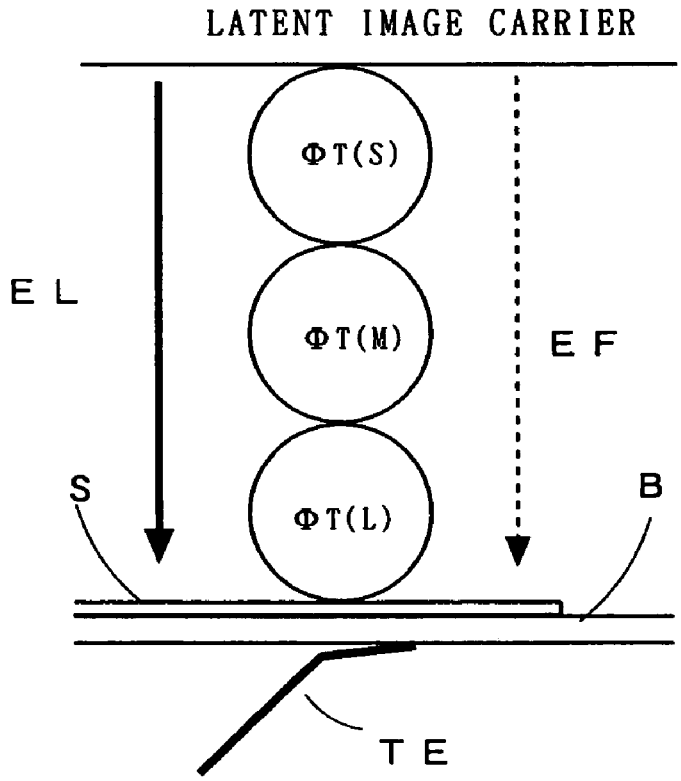
FIGS. 7(*a*) and 7(B) are illustrations for explaining the charging state of toner particles on a recording medium.
Figure 7:
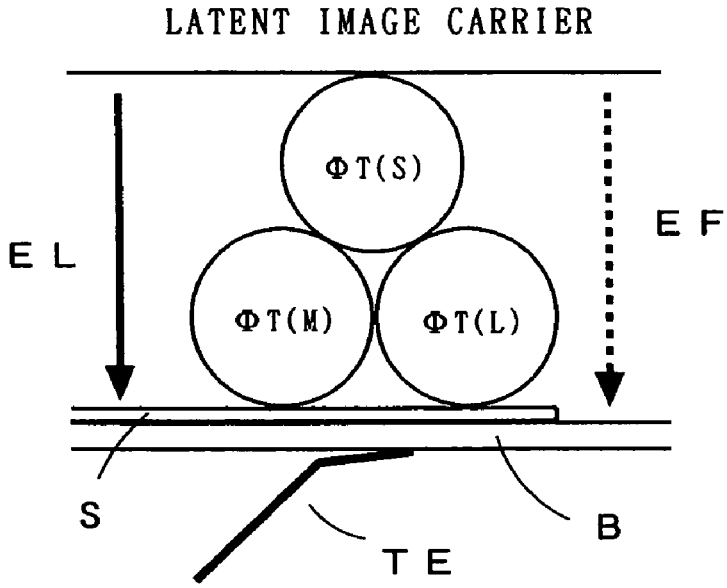

FIGS. 7(A), 7(B) are illustrations for explaining the charge state of a toner onto a recording medium fed by a feeding belt.

FIG. 7(A) shows an example of developed and transferred state of a composite solid image in which toner particles line up.

The development and transfer to a recording medium S is conducted in descending order from a toner having the largest work function Φ(L) to a toner having the smallest work function Φ(S). The toner particles electrostatically adhere to the recording medium S on the feeding belt B. The transfer efficiency is increased. This is attributed to the fact that electrons (charge) move in a charge moving direction EL as shown by an arrow to reduce the charge of the uppermost toner, whereby the toner particles stick with each other because of repulsive force so as to improve the stack and the charge moving direction is the same as the direction of the transfer field EF.

As shown in Table 3, the work function of a paper sheet commonly used in a copying machine or a printer is about 5.6 eV. If a toner having a work function smaller than that of the paper sheet is transferred, the toner tends to be positively charged.

To electrostatically hold two or more toner layers on the recording medium, the larger negative charge of toner is advantageous because a transfer electrode TE behind the recording medium is of positive polarity. When a plurality of toner layers are superposed, the work function of toner of the first layer is at least 5.6 eV or more, i.e. equal to or more than the work function of the recording medium, thereby keeping the negative state and thus advantageously holding the toner on the recording medium.

In case of a single layer or less, as the charge distribution of toner is significantly on the negative side by regulating the toner layer thinner, i.e. by the substantially single regulation, the amount of positively charged toner particles becomes vanishingly small. Therefore, no or little problem due to reversely transferred toner particles is caused.

Since the feeding belt having a work function smaller than the work function of the recording medium is used in the present invention, the transfer field acts effectively. Therefore, preferable result of transfer may be obtained.

FIG. 7(B) shows an example of developed and transferred state of a halftone image in which toner particles are arranged adjacent to each other. The development and transfer is conducted in descending order from a toner having the largest work function Φ(L) to a toner having the smallest work function Φ(S). The toner particles electrostatically adhere to a recording medium S on the feeding belt B. The transfer efficiency is increased. This is attributed to the fact that electrons (charge) move in a direction as shown by an arrow to reduce the charge of the uppermost toner, whereby the toner particles stick with each other because of repulsive force so as to improve the stack and the charge moving direction is the same as the direction of the transfer field similarly to the case of FIG. 7(A). The toner particles are held and the negative effect of reversely transferred toner particles can be minimized similarly to the case of composite toners shown in FIG. 7(A).

TABLE 3

| Manufacturer | Brand Name | Work Function (eV) |
|---|---|---|
| Fuji Xerox Office Supply | Full-color copying machine paper J | 5.66 |
| Fuji Xerox Office Supply | PPC paper L | 5.61 |
| Fuji Xerox Office Supply | Full-color copying machine paper JD | 5.65 |
| Fuji Xerox Office Supply | P paper | 5.62 |
| NBS Ricoh | My recycled paper 100 | 5.61 |
| Ricoh | PPC paper TYPE 6200 | 5.56 |
| STEINBEIS | RECYCLING COPY | 5.59 |
| NEENAH | Bond White | 5.63 |
| Xerox | 4024DP | 5.71 |
| Seiko Epson | PRPPAN3n | 5.61 |
| | Quality paper 135k | 5.60 |
| | Postcard paper | 5.64 |

Figure 8:
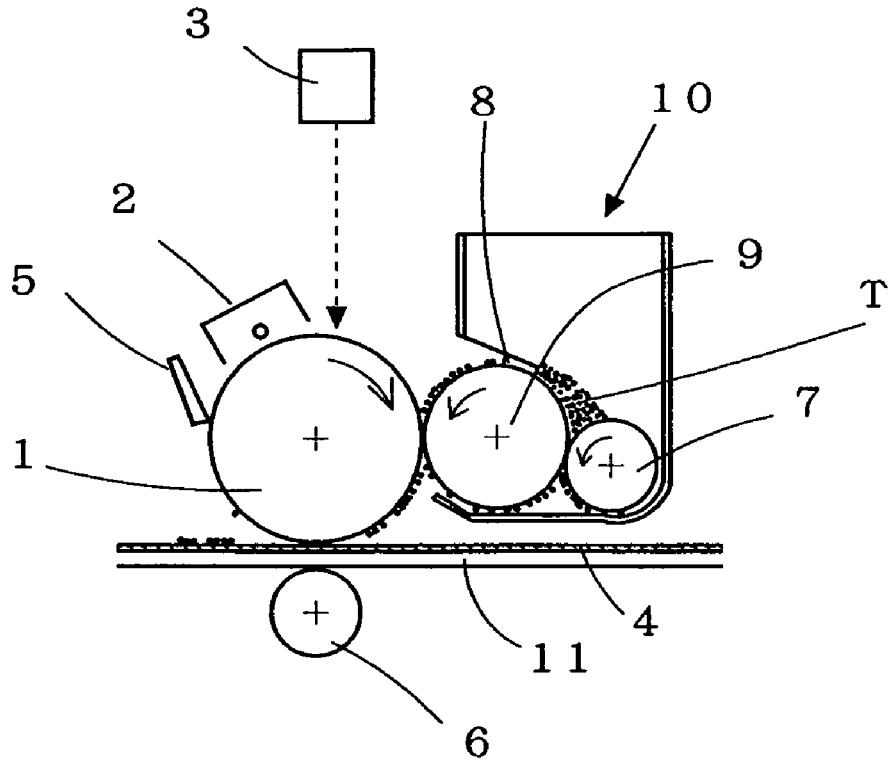
FIGS. 8(A) and 8(B) are illustrations for explaining an image forming apparatus of the present invention.
Figure 8:
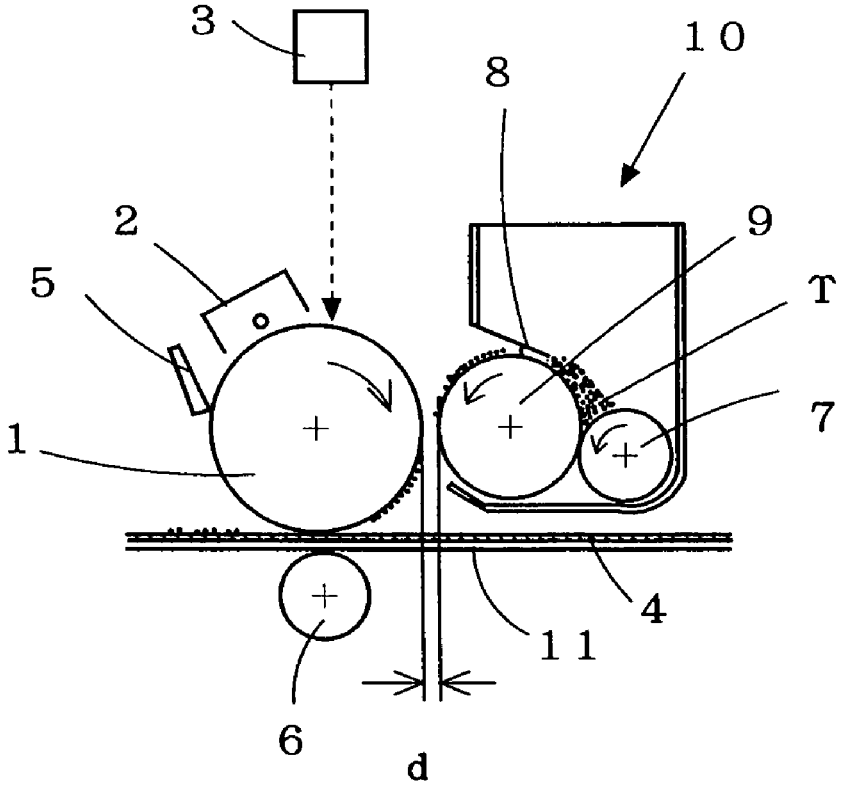

FIGS. 8(A), 8(B) are illustrations for explaining an image forming apparatus having a feeding belt for recording media.

FIG. 8(A) shows an example of a contact developing process in an image forming apparatus having a feeding belt for recording media. A photoreceptor 1 is a photosensitive drum which is 24-86 mm in diameter and rotates at a surface velocity of 60-300 mm/sec. After the surface of the photoreceptor 1 is uniformly negatively charged by a corona charging device 2, the photoreceptor 1 is exposed by an exposure device 3 according to information to be recorded. In this manner, an electrostatic latent image is formed.

A developing device 10 is a single-component developing device which supplies single-component non-magnetic toner T onto the organic photoreceptor to reversely develop the electrostatic latent image on the organic photoreceptor, thereby forming a visible image. The single-component non-magnetic toner T is housed in the developing means. The toner is supplied to the development roller 9 by a toner supply roller 7 which rotates in the counter-clockwise direction as shown in FIG. 8(A). The development roller 9 rotates in the counter-clockwise direction with holding the toner T, supplied by the toner supply roller 7, on the surface thereof so as to carry the toner T to contact portion with the organic photoreceptor, thereby making the electrostatic latent image on the organic photoreceptor 1 visible.

The development roller 9 may be a roller made of a metallic pipe having a diameter of 16-24 mm, of which surface is treated by plating or blasting or which is formed on its peripheral surface with a conductive elastic layer made of butadiene rubber, styrene-butadiene rubber, ethylene propylene rubber, polyurethane rubber, or silicone rubber to have a volume resistivity of from $10^4$ Ω·cm to $10^8$Ω·cm and hardness of from 40 to 70° (Asker A hardness). A developing bias voltage is applied to the development roller 9 via the shaft of the pipe from a power source (not shown). The entire developing device 10 composed of the development roller 9, the toner supply roller 7, and a toner regulating blade 8 may be biased against the organic photoreceptor by a biasing means such as a spring (not shown) with a pressure load of from 19.6 N/m to 98.1 N/m, preferably from 24.5 N/m to 68.6 N/m to have a nip width of from 1 mm to 3 mm.

The regulating blade 8 is formed by pasting rubber tips on a stainless steel, a phosphor bronze, a rubber plate, or a metal sheet. The regulating blade is biased against the development roller by a biasing means such as a spring (not shown) or the bounce itself as an elastic member with a linear load of 245 to 490 mN/cm to make a toner layer on the development roller to have the number of stories made up of toner particles becomes 1 or 2.

The dark potential of the photoreceptor is preferably set in a range from −500 V to −700 V, the light potential thereof is preferably set in a range from −50 V to −150 V, and the developing bias is preferably set in a range from −100 V to −400 V, but not shown. The development roller and the toner supply roller are preferably in the same potential.

In the contact developing method, the peripheral velocity of the development roller which rotates in the counter-clockwise direction is preferably set to have a ratio of peripheral velocity from 1.1 to 2.5, preferably 1.2 to 2.2 relative to that of the organic photoreceptor which rotates in the clockwise direction. Therefore, even small-diameter toner particles are reliably supplied enough to an area where the development roller is in contact with the organic photoreceptor.

Though there is no special limitation on the relation between the work functions of the regulating blade and the development roller and the work function of the toner, it is preferable that the work functions of the regulating blade and the development roller are each set to be smaller than the work function of the toner. In this case, the toner being in contact with the regulating blade is negatively charged, thereby achieving further uniform negative charge of the toner. Voltage may be applied to the regulating blade 8 to conduct charge injection to the toner, thereby controlling the charge of the toner.

The recording medium 4 is fed between the photoreceptor 1 having visible image and the backup roller 6 by the feeding belt 21 where the visible image is transferred to the recording medium 4.

FIG. 8(B) shows an example of an image forming apparatus of a type employing the non-contact developing process having a feeding belt for recording media. In this process, the development roller 9 and the photoreceptor 1 confront each other to have a developing gap "d" therebetween. The developing gap is preferably in a range of from 100 to 350 μm. As for the developing bias, the voltage of a direct current is preferably in a range of from −200 to −500 V and an alternating current to be superimposed on the direct current is preferably in a range from 1.5 to 3.5 kHz with a P-P voltage in a range from 1000 to 1800 V, but not shown. In the non-contact developing process, the peripheral velocity of the development roller which rotates in the counter-clockwise direction is preferably set to have a ratio of peripheral velocity of 1.1 to 2.5, preferably 1.2 to 2.2 relative to that of the organic photoreceptor which rotates in the clockwise direction.

The development roller 9 rotates in the counter-clockwise direction as shown in FIG. 8(B) with holding the toner T, supplied by the toner supply roller 7, adhering thereon so as to carry the toner T to a confronting portion with the organic photoreceptor. By applying a bias voltage, composed of an alternating current superimposed on a direct current, to the confronting portion between the organic photoreceptor and the development roller, the toner T vibrates between the surface of the development roller and the surface of the organic photoreceptor, thereby developing an image. In the present invention, the contact charge among toner particles is conducted during the vibration of the toner T between the surface of the development roller and the surface of the organic photoreceptor, whereby toner particles having small-particle diameter are controlled to be negatively charged and thus may reduce the amount of fog toner particles.

The recording medium 4 is fed between the photoreceptor 1 with a visible image and the backup roller 6 by the feeding belt 21. In case of using a backup roller, the pressing load to the photoreceptor 1 by the backup roller 6 is preferably in a range of from 18 to 45 N/m, preferably from 26 to 38 N/m.

This ensures the contact between the toner particles and the recording medium, whereby the movement of charge (electrons) between the toner particles is caused so as to improve the transfer efficiency. The same is true for the contact development process. The other items of the image forming apparatus of a type employing the non-contact developing process are the same as those of the image forming apparatus of a type employing the contact developing process.

By employing the developing process as shown in FIG. 8(A) or 8(B) with developing devices holding four unicolor toners (developers) of yellow Y, cyan C, magenta M, and black K, respectively and the corresponding photoreceptors, an apparatus capable of forming a full color image can be provided.

The feeding belt for recording media such as paper sheets, synthetic resin films for overhead projector can be manufactured from a composition having a predetermined volume resistivity. For example, as a binder composing the composition, rubber materials such as polyurethane rubber, nitrile rubber (NBR), ethylene propylene rubber (EPDM), and silicone rubber, and synthetic resin materials such as polyester, polyethylene terephthalate, polycarbonate, and poly vinylidene fluoride may be used alone or in combination. Examples of the conductive material include conductive carbon blacks such as acetylene black, ketjen black, and furnace black. Other materials such as a dispersant and a hardening agent are mixed with the aforementioned materials. A belt substrate is manufactured by a kneading step, an extruding step, a cooling step, and a grinding step.

The belt substrate may be a lamination of a plurality of layers which are made of different materials or have different proportions. The lamination structure facilitates the control of the strength and the electrical characteristics, thereby enabling the manufacture of a belt substrate having excellent characteristics. An outer layer having desired characteristics may be formed by applying various treatments on the surface of the belt substrate.

The thickness of the feeding belt is preferably in a rang of from 0.1 mm to 1.5 mm. The volume resistivity of the feeding belt is preferably in a range of from $10^8$ Ω·cm to $10^{11}$ Ω·cm. The volume resistivity less than $10^8$ Ω·cm reduces the attraction relative to paper sheets. On the other hand, the volume resistivity more than $10^{11}$ Ω·cm requires larger transfer voltage or larger transfer current, that is, requires a large-capacity power supply or a high-voltage power supply having larger rating, so it is undesirable.

Figure 9:
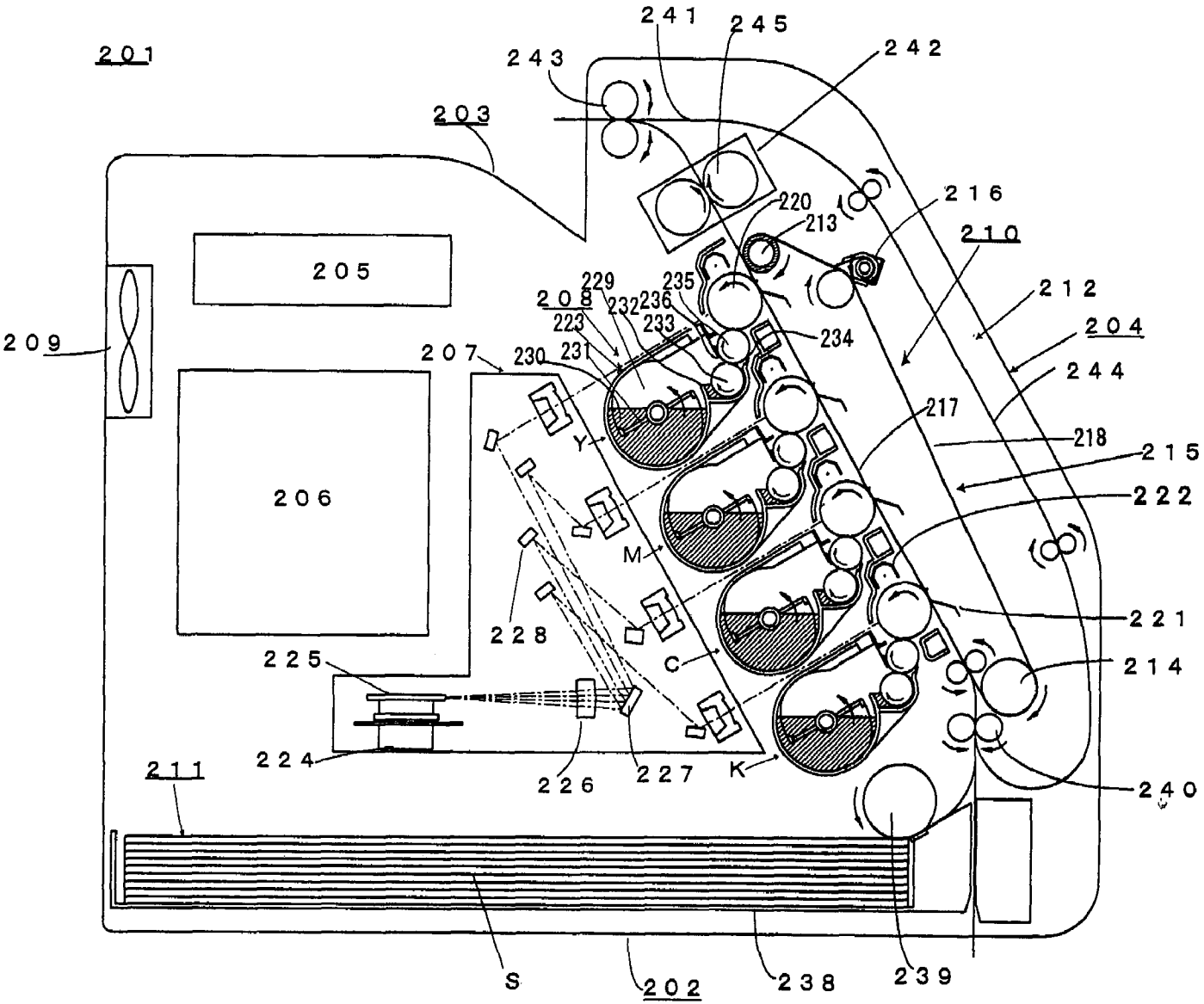
FIG. 9 is an illustration for explaining an example of full color printer of tandem system of the present invention.

FIG. 9 shows a schematic front view showing an image forming apparatus of tandem-type employing the feeding belt of the present invention.

In FIG. 9, the image forming apparatus 201 of this embodiment comprises the housing 202, an outfeed tray 203 which is formed in the top of the housing 202, a door body 204 which is attached to the front of the housing 202 in such a manner that the door body is able to open or close freely. Arranged within the housing 202 are a control unit 205, a power source unit 206, an exposure unit 207, an image forming unit 208, an air fan 209, a transfer unit 210, and a sheet supply unit 211. Arranged inside the door body 204 is a sheet handling unit 212. The respective units are designed to be detachable relative to the apparatus. In this case, each unit can be detached from the apparatus for the purpose of repair or replacement.

The transfer unit 210 comprises a driving roller 213 which is disposed in an upperr portion of the housing 202 and is driven by a driving means (not shown) to rotate, a driven roller 214 which is disposed diagonally below the driving roller 213, a feeding belt 215 which is laid around the two rollers with certain tension and is driven to circulate in a direction indicated by an arrow (the counter-clockwise direction) in FIG. 9, and a cleaning means 216 which abuts on the surface of the feeding belt 215. The driving roller 213 and the feeding belt 215 are arranged obliquely to the upper left of the driven roller as seen in FIG. 9. Accordingly, during the operation of the feeding belt 215, the tension side (side tensioned by the driving roller 213) 217 takes a lower side and the loose side 218 takes an upper side.

A cleaning means 216 is disposed on the belt loose side 218.

On the back of the feeding belt 215, transfer members 221 composed of leaf spring electrodes are disposed. The transfer members 221 are pressed into contact with the back of the feeding belt 215 by their elastic force at locations corresponding to image carriers 220 of respective unicolor image forming sub-units Y, M, C, and K composing the image forming unit 208, described later. A transfer bias is applied to each transfer member 221.

The image forming unit 208 comprises the unicolor image forming sub-units Y (for yellow), M (for magenta), C (for cyan), and K (for black) for forming multi-color images (in this embodiment, four-color images). Each unicolor image forming sub-unit Y, M, C, K has an image carrier 220 composed of a photoreceptor having an organic photosensitive layer or an inorganic photosensitive layer formed thereon, a charging means 222, composed of a corona charger or a charging roller, and a developing means 223 which are arranged around the image carrier 220.

The unicolor image forming sub-units Y, M, C, K are arranged such that the image carriers 220 are in contact with the tension side 217 of the feeding belt 215. As a result, the unicolor image forming sub-units Y, M, C, K are arranged obliquely to the left of the driving roller 213. The respective image carriers 220 are driven to rotate in the reverse direction of the rotational direction of the feeding belt 215 as shown in FIG. 9.

The exposure unit 207 is disposed in a space formed obliquely below the image forming unit 208 and has a polygon mirror motor 224, a polygon mirror 225, an f-θ lens 226, a reflection mirror 227, and reflective mirrors 228. In the exposure unit 207, image signals corresponding to the respective colors are formed and modulated according to the common data clock frequency and are then radiated. The radiated image signals are aimed to the image carriers 220 of the unicolor image forming sub-units Y, M, C, K via the f-θ lens 226, the reflection mirror 227, and the reflective mirrors 228, thereby forming latent images. The reflective mirrors 228 act as to make the respective lengths of the scanning lines to the image carriers 220 of the unicolor image forming sub-units Y, M, C, K substantially equal to each other.

Now, the developing means 223 will be described taking the unicolor image forming sub-unit Y as an example. In this embodiment, since the unicolor image forming sub-units Y, M, C, K are obliquely arranged to the left in the drawing, toner storage containers 229 are arranged obliquely downward to the lower left of the image carriers 220.

That is, the developing means 223 each comprises the toner storage container 229 storing toner, a toner storage area 230 (indicating by hatching) formed in the toner storage container 229, a toner agitating member 231 disposed inside the toner storage area 230, a partition 232 defined in an upper portion of the toner storage area 230, a toner supply roller 233 disposed above the partition 232, an antiscattering blade 234 attached to the partition 232 to abut the toner supply roller 233, a development roller 235 arranged to come close to both the toner supply roller 233 and the image carrier 220, and a regulating blade 236 arranged to abut the development roller 235.

The development roller 235 and the toner supply roller 233 are driven to rotate in a reverse direction of the rotational direction of the image carrier 220, while the agitating member 231 is driven to rotate in a reverse direction of the rotational direction of the supply roller 233 as shown by arrows. Toner agitated and scooped up by the agitating member 231 in the toner storage area 230 is supplied to the toner supply roller 233 along the upper surface of the partition 232. Friction is caused between the supplied toner and a charge blade (not shown) made of flexible material so that mechanical adhesive force and adhesive force by triboelectric charging are created relative to the rough surface of the supply roller 233. By these adhesive forces, the toner is supplied to the surface of the development roller 235.

The toner supplied to the development roller 235 is regulated into a thin layer having a predetermined thickness by the regulating blade 236. The toner layer as a thin layer is carried to the image carrier 220 so as to develop a latent image on the image carrier 220 at a development area where the development roller 235 is close to the image carrier 220.

The sheet supply unit 211 comprises a sheet cassette 238 in which a pile of recording media S are held, and a pick-up roller 239 for feeding the recording media S from the sheet cassette 238 one by one.

The sheet handling unit 212 comprises a pair of gate rollers 240 (one of which is positioned on the housing 202 side) for defining the timing of the feeding of a receiving medium S to the transfer portion at the right time, the driving roller 213 and the paper feeding belt 215, a sheet feeding passage 241, a fixing means 242, a pair of outfeed rollers 243 and a dual-side printing passage 244. The fixing means 242 comprises a pair of fuser rollers 245 at least one of which has a built-in heating element such as a halogen heater, a pressure means pressing at least one of the fuser rollers 245 to the other for fixing a transferred image onto a recording medium S so that an image transferred to a recording medium is fixed to the recording medium at a nip portion formed by the pair of fixing rollers 245 at a predetermined temperature.

In the present invention, the feeding belt 215 is arranged obliquely to the left of the driven roller 214 in the drawing so that the fixing means 242 is disposed above the feeding belt 215, thereby achieving the reduction in size of the apparatus and preventing heat generated from the fixing means 242 from adversely affecting the exposure means 207, the feeding belt 215, and the respective unicolor image forming sub-units Y, M, C, K.

EXAMPLES

Hereinafter, the present invention will be described in further detail with reference to Examples. First, production examples of organic photoreceptor, development roller, toner regulating blade, and intermediate transfer medium used in the following examples.

Product Example of Organic Photoreceptor (OPC 1)

An aluminum pipe of 85.5 mm in diameter was used as a tubular conductive substrate. A coating liquid was prepared by dissolving and dispersing 6 parts by weight of alcohol-soluble nylon (CM8000 available from Toray Industries, Inc.) and 4 parts by weight of titanium oxide fine particles treated with aminosilane into 100 parts by weight of methanol. The coating liquid was coated on the peripheral surface of the conductive substrate by the ring coating method and was dried at a temperature 100° C. for 40 minutes, thereby forming an undercoat layer having a thickness of from 1.5 to 2 μm on the conductive substrate.

A dispersion liquid was prepared by dispersing 1 part by weight of oxytitanium phthalocyanine as a charge generation agent, 1 part by weight of butyral resin (BX-1 available from Sekisui Chemical Co., Ltd.), into 100 parts by weight of dichloroethane for 8 hours by a sand mill with glass beads of 1 mm in diameter. The dispersion liquid was applied on the undercoat layer by the ring coating method and was dried at a temperature of 80° C. for 20 minutes, thereby forming a charge generation layer having a thickness of 0.3 μm.

A liquid was prepared by dissolving 40 parts by weight of charge transport material of a styryl compound having the following structural formula (1) and 60 parts by weight of polycarbonate resin (Panlite TS available from Teijin Chemicals Ltd.) into 400 parts by weight of toluene. The liquid was applied on the obtained charge generation layer by the dip coating method and was dried to have a thickness of 22 μm when dried, thereby forming a charge transport layer. In this manner, an organic photoreceptor (1) having a double-layer type photosensitive layer was obtained.

Structural Formula (1)

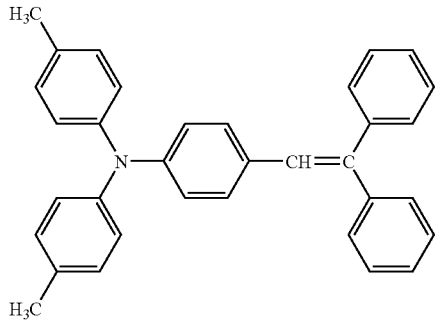

A test piece was made by cutting a part of the obtained organic photoreceptor and was measured by using a surface analyzer (AC-2 available from Riken Keiki Co., Ltd.) with radiation amount of 500 nW. The measured work function was 5.47 eV.

Product Example of Organic Photoreceptor (OPC 2)

An organic photoreceptor (OPC 2) was obtained in the same manner as the above organic photoreceptor (OPC 1) except that an aluminum pipe of 30 mm in diameter was used and a distyryl compound having the following structural formula (2) was employed as the charge transport material.

Structural Formula (2)

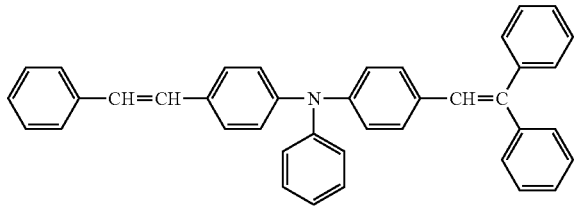

The work function of the obtained organic photoreceptor was measured in the same manner as mentioned above. The work function was 5.50 eV.

Product Example of Organic Photoreceptor (OPC 3)

An organic photoreceptor (OPC 3) was obtained in the same manner as the above organic photoreceptor (OPC 1) except that an aluminum pipe of 140 mm in diameter was used. The work function of the obtained organic photoreceptor was measured in the same manner as mentioned above. The work function was 5.47 eV.

Product Example of Organic Photoreceptor (OPC 4)

An organic photoreceptor (OPC 4) was obtained in the same manner as the above organic photoreceptor (OPC 2) except that a butadiene compound having the following structural formula (3) was employed as the charge transport material.

Structural Formula (3)

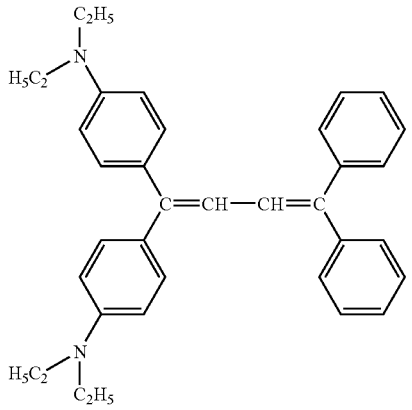

The work function of the obtained organic photoreceptor was measured in the same manner as mentioned above. The work function was 5.27 eV.

Product Example of Organic Photoreceptor (OPC 5)

An organic photoreceptor (OPC 5) was obtained in the same manner as the above organic photoreceptor (OPC 4) except that an aluminum pipe of 140 mm in diameter was used. The work function of the obtained organic photoreceptor was measured in the same manner as mentioned above. The work function was 5.27 eV.

Product Example of Organic Photoreceptor (OPC 6)

An organic photoreceptor (OPC 6) was obtained in the same manner as the above organic photoreceptor (OPC 2) except that an aluminum pipe of 40 mm in diameter was used.

The work function of the obtained organic photoreceptor was measured in the same manner as mentioned above. The work function was 5.48 eV.

Product Example of Development Roller

An aluminum pipe of 18 mm in diameter was surfaced with nickel plating of 10 μm in thickness to have surface roughness (Rz) of 4 μm, thereby obtaining a development roller. The work function of the surface of the obtained development roller was measured. The work function was 4.58 eV.

Product Example of Regulating Blade

A conductive polyurethane tip of 1.5 mm in thickness was attached to a stainless steel plate of 80 μm in thickness by conductive adhesives, thereby making a regulating blade. The work function of the polyurethane portion was measured in the same manner as aforementioned. The work function was 5 eV.

Product Example of Intermediate Transfer Belt

A uniformly dispersed liquid composed of:

| | |
|---|---|
| vinyl chloride-vinyl acetate copolymer | 30 parts by weight; |
| conductive carbon black | 10 parts by weight; and |
| methyl alcohol | 70 parts by weight |

was applied on a polyethylene terephthalate resin film of 130 μm in thickness with aluminum deposited thereon by the roll coating method to have a thickness of 20 (μm and dried to form an intermediate conductive layer.

Then, a coating liquid made by mixing and dispersing the following components:

| | |
|---|---|
| nonionic aqueous polyurethane resin (solid ratio: 62 wt. %) | 55 parts by weight; |
| polytetrafluoroethylene emulsion resin (solid ratio: 60 wt. %) | 11.6 parts by weight; |
| conductive titanium oxide | 5 parts by weight; |
| conductive tin oxide | 25 parts by weight; |
| polytetrafluoroethylene fine particles (max particle diameter: 0.3 μm or less) | 34 parts by weight; |
| polyethylene emulsion (solid ratio: 35 wt. %) | 5 parts by weight; and |
| deionized water | 20 parts by weight |

was coated on the intermediate conductive layer by the roll coating method to have a thickness of 10 μm and dried in the same manner so as to form a transfer layer.

The obtained coated sheet was cut to have a length of 540 mm. The ends of the cut piece are superposed on each other with the coated surface outward and welded by ultrasonic, thereby making an intermediate transfer belt. The volume resistivity of this transfer belt was $8.8\times10^{9}$ Ω·cm. The work function was 5.69 eV and the normalized photoelectron yield was 7.39.

Production Example of Feeding Belt 1

85 parts by weight of polybutylene terephthalate, 15 parts by weight of polycarbonate, and 15 parts by weight of acetylene black (available from Denki Kagaku Kogyo K.K.) were preliminarily mixed by a mixer under nitrogen gas atmosphere. The mixture was further kneaded by a twin-shaft extruder under nitrogen gas atmosphere so as to form a pellet. The pellet was extruded into a tubular film of 170 mm in outer diameter and 160 μm in thickness by a single-shaft extruder having an annular die at a temperature of 260° C. Then, the inner diameter of the extruded melt tube was defined by a cooling inside mandrel supported on the same axis as the annular die and the tube was cooled and solidified, thereby manufacturing a seamless tube. The seamless tube was cut to hive predetermined dimensions so as to obtain a seamless belt of 172 mm in outer diameter, 342 mm in width, and 150 μm in thickness. The volume resistivity of this feeding belt was $3.2\times10^{8}$ Ω·cm. The work function was 5.19 eV and the normalized photoelectron yield was 10.88.

Further, 100 parts by weight of urethane modified epoxy resin (ADEKA RESIN EPU-8 available from Asahi Denka Kogyo K.K.), 3.5 parts by weight of conductive carbon black (VULCAN XC72R available from Cabot corporation), 2.1 parts by weight of polymer dispersing agent (AJISPER PB711 available from Ajinomoto-Fine-Techno Co., Inc.), and 75 parts by weight of toluene were dispersed by a paint conditioner for 2 hours and, after that, 8 parts by weight of hardener (EH-200 available from Asahi Denka Kogyo K.K.) was added and sufficiently agitated so as to prepare a coating liquid for the conductive undercoat layer. The coating liquid was applied to the surface of the aforementioned seamless belt according to a spray coating method and was dried (at 70° C. for 6 hours), thereby forming an outer layer of 13 μm in thickness. The work function of the obtained semi-conductive coating layer was 5.36 eV.

Example 1-1

A monomer mixture composed of 80 parts by weight of styrene monomer, 20 parts by weight of butyl acrylate, and 5 parts by weight of acrylic acid was added into a water soluble mixture composed of 105 parts by weight of water, 1 part by weight of nonionic emulsifier (Emulgen 950 available from Dai-ichi Kogyo Seiyaku Co., Ltd.), 1.5 parts by weight of anionic emulsifier (Neogen R available from Dai-ichi Kogyo Seiyaku Co., Ltd.), and 0.55 parts by weight of potassium persulfate and was agitated and polymerized in nitrogen gas atmosphere at a temperature of 70° C. for 8 hours. By cooling after polymerization reaction, milky white resin emulsion having a particle size of 0.25 μm was obtained.

Then, a mixture composed of 200 parts by weight of resin emulsion obtained above, 20 parts by weight of polyethylene wax emulsion (available from Sanyo Chemical Industries, Ltd.), and 7 parts by weight of Phthalocyanine Blue was dispersed into 0.2 liters of water containing dodecyl benzene sulfonic acid sodium as a surface active agent in an amount of 0.2 parts by weight, and was adjusted to have pH of 5.5 by adding diethyl amine. After that, aluminum sulfate as electrolyte was added in an amount of 0.3 parts by weight with agitation and subsequently agitated at a high speed and thus dispersed by using an agitator (TK homo mixer manufactured by Tokushu Kika Kogyo Co., Ltd.).

Further, 40 parts by weight of styrene monomer, 10 parts by weight of butyl acrylate, and 5 parts by weight of zinc salicylate were added with 40 parts by weight of water, agitated in nitrogen gas atmosphere, and heated at a temperature of 90° C. in the same manner. By adding hydrogen peroxide, polymerization was conducted for 5 hours to grow up particles. After the polymerization, the pH was adjusted to be 5 or more while the temperature was increased to 95° C. and then maintained for 5 hours in order to improve the bonding strength of associated particles.

After that, the obtained particles were washed with water and dried under vacuum at a temperature of 45° C. for 10 hours. The cyan toner obtained in this manner has a mean particle diameter 6.8 μm and a degree of circularity of 0.98.

The measurement of degree of circularity was conducted by using a flow-type particle analyzer (FPIA2100 available from Sysmex corporation) and was represented by the following equation (1):

$$R=L_0/L_1 \quad (1)$$

wherein "$L_1$" is the circumferential length (μm) of a projected image of an object toner particle, and "$L_0$" is the circumferential length (μm) of a perfect circle having the same area as that of the projected image.

The work function of the cyan toner mother particles was measured by a surface analyzer (AC-2 manufactured by Riken Keiki Co., Ltd) with radiation amount of 500 nW. The measured value was 5.57 eV.

To 100 parts by weight of the toner mother particles, hydrophobic silica having a mean primary particle diameter of 7 nm was added in an amount of 0.1 parts weight and hydrophobic silica having a mean particle diameter of 40 nm was added in an amount of 0.3 parts by weight, as fluidity improving agents. After that, hydrophobic rutile/anatase type titanium oxide having a mean primary particle diameter of 20 nm was added in an amount of 0.5 parts by weight, alumina having a mean primary particle diameter of 13 nm was added in an amount of 0.2 parts by weight, and metallic soap particles shown in following Table 4 were added in an amount of 0.2 parts by weight and were mixed so as to obtain a toner 2 (C2) through a toner 5 (C5). It should be noted that the toner 1 (C1) was a toner without adding metallic soap particles.

The work functions of the toners were measured by the surface analyzer (AC-2 manufactured by Riken Keiki Co., Ltd) with radiation amount of 500 nW. The results were:

Toner 1(C1): 5.56 eV;
Toner 2(C2): 5.52 eV;
Toner 3(C3): 5.56 eV;
Toner 4(C4): 5.55 eV; and
Toner 5(C5): 5.54 eV.

A four-cycle color printer described as the third image forming apparatus as shown in FIG. 5 was made by assembling the organic photoreceptor (OPC1), the development roller, the toner regulating blade, and the transfer belt which were previously manufactured. For the respective obtained toners 1 (C1) through 5 (C5), image forming test was conducted by loading the toner into only the cyan toner developing device 10C of the four-cycle color printer and under the following conditions. The purpose of this example is to show the effects by the addition of metallic soap particles to the toner mother particles.

The conditions for forming images were as follows. That is, the peripheral velocity of the organic photoreceptor was set to 180 mm/s, the peripheral velocity of the development roller was set to be higher than that of the photoreceptor by 1.3 times, and the peripheral velocity of the transfer belt as the intermediate transfer medium was set to be higher than that of the photoreceptor by 3%. If the difference exceeds 3%, flush is produced on transferred images.

The developing gap between the development roller and the photoreceptor was set to 210 μm (the space was adjusted by a gap roller) and an alternating current to be superimposed on the direct current developing bias of −200 V was set to have a frequency of 2.5 kHz and a P-P voltage of 1400 V, and the development roller and the supply roller were set to have the same potential.

The regulation by the toner regulating blade was controlled such that the carrying amount of toner on the development roller becomes from 0.38 mg/cm$^2$ to 0.40 mg/cm$^2$. Under the conditions, the charge characteristics (charge amount (μc/g), number rate % of positively charged toner) of each toner on the development roller after printing an image of 5% coverage on two sheets of paper were measured by a charge distribution measuring system (E-SPART III available from Hosokawa Micron Corporation). The results of the measurements are shown in Table 4 and Table 5.

In addition, a solid image was first printed and, then, the image density (reflection density) after fixed and the degree of fog toner at non-image portions on the organic photoreceptor were measured by forming a solid image by the tape transfer method. The degree of reverse transfer toner particles which returned to the photoreceptor after formation of a solid image was also measured by the tape transfer method. The results are shown in Table 5.

It should be noted that the tape transfer method is a method comprising attaching a tape (mending tape available from Sumitomo 3M Ltd.) onto toner on the photoreceptor to transfer toner particles onto the mending tape, then attaching the tape on a white plane paper, and obtaining the difference by subtracting the reflection density of the tape itself from the measured reflection density value.

For each toner, the number liberation ratio of external additive particles (hydrophobic silica particles, hydrophobic titanium oxide) from toner mother particles was obtained by using a particle analyzer (PT1000 available from Yokogawa Electric Corporation). The results are also shown in Table 5. It should be noted that the number liberation ratio was calculated from the number of detected elements (Si, Ti) and thus defined by the following equation:

Number liberation ratio (%)=(number of detected elements of liberated external additives+total number of detected elements of external additives)×100

TABLE 4

| Toner | Work function difference (eV) (toner mother particles) − (metallic soap particles) | Metallic soap particles | Solid OD value | Charge amount (μc/g) |
|---|---|---|---|---|
| Toner 1(C1) | — | None | 1.26 | −13.19 |
| Toner 2(C2) | 0.36 | M1StAl | 1.21 | −9.13 |
| Toner 3(C3) | −0.07 | M2StZn | 1.32 | −13.84 |
| Toner 4(C4) | 0 | M3StMg | 1.37 | −15.14 |
| Toner 5(C5) | 0.08 | M4StCa | 1.37 | −15.08 |

TABLE 5

| Toner | Number % of positively charged toner | OD value of fog toner | OD value of reverse transfer toner | Number liberation ratio (%) Si | Number liberation ratio (%) Ti |
|---|---|---|---|---|---|
| Toner 1(C1) | 9.5 | 0.09 | 0.02 | 0.56 | 1.42 |
| Toner 2(C2) | 13.7 | 0.12 | 0.04 | 0.48 | 0.91 |
| Toner 3(C3) | 6.9 | 0.06 | 0.01 | 0.48 | 1.02 |
| Toner 4(C4) | 5.7 | 0.04 | 0.01 | 0.38 | 0.96 |
| Toner 5(C5) | 6.2 | 0.05 | 0.01 | 0.50 | 0.96 |

As apparent from the above tables, as for the relation of work function between the toner mother particles and the metallic soap particles, it was found that the toner 3(C3) through the toner 5 (C5) in which metallic soap particles having substantially the same work function (±0.15 eV) as that of the toner mother particles were added exhibited higher solid OD value and relatively higher charge amount, with the result that the amount of positively charged toner was reduced and the amount of fog toner and the amount of reverse transfer toner were also reduced.

It was found that the best one was magnesium stearate (M3StMg) having the same work function as that of the toner mother particles. As for the number liberation ratio of external additives, any one of toners in which metallic soap particles were added to toner mother particles exhibited smaller value than the toner 1(C1) as a metallic-soap-free toner. That is, it was found that the addition of metallic soap particles is effective in preventing the liberation of external additives.

Example 1-2

100 parts by weight of a mixture (available from Sanyo Chemical Industries, Ltd.) which was 50:50 (by weight) of polycondensate polyester, composed of aromatic di-carboxylic acid and bisphenol A of alkylene ether, and partially crosslinked compound of the polycondensate polyester by polyvalent metal, 5 parts by weight of Phthalocyanine Blue, 3 parts by weight of polypropylene as a release agent having a melting point of 152° C. and a weight-mean molecular weight Mw of 4000, and 4 parts by weight of metal complex compound of salicylic acid (E-81 available from Orient Chemical Industries, Ltd.) as a charge control agent were uniformly mixed by using a Henschel mixer, then kneaded by a twin-shaft extruder at an inner temperature of 150° C., and then cooled.

The cooled matter was roughly pulverized into pieces of 2 square mm or less and then pulverized into fine particles by a jet mill. The fine particles were classified by a classifier of rotor type, thereby obtaining classified toner particles having a mean particle diameter of 7.6 μm and a degree of circularity of 0.911. The classified toner was surface-treated by adding hydrophobic silica (having a mean primary particle diameter of 7 nm and a specific surface area of 250 $m^2/g$) in an amount of 0.2% by weight and then was partially spheroidized by using a hot air spheroidizing apparatus (SFS-3 available from Nippon Pneumatic Mfg. Co., Ltd.) at a treatment temperature of 200° C. After that, the surface-treated toner was classified again in the same manner, thereby forming toner mother particles having a mean particle diameter of 7.6 μm and a degree of circularity of 0.940. The work function of the toner mother particles was 5.45 eV.

To the toner mother particles, 0.5% by weight of hydrophobic silica particles (having a mean primary particle diameter of 12 nm) surface-treated with hexamethyldisilazane (HMDS) and 0.5% by weight of hydrophobic silica particles (having a mean primary particle diameter of 40 nm) surface-treated by the same treatment were added and mixed. After that, 0.5% by weight of hydrophobic rutile/anatase type titanium oxide particles (having a mean primary particle diameter of 20 nm) treated with a silane coupling agent and 0.2% by weight of metallic soap particles shown in the following Table 5 were added and mixed so as to obtain a toner 7 (C7) through a toner 13 (C13). It should be noted that the toner 6 (C6) was a toner without adding metallic soap particles.

The work functions of the obtained toners were measured in the same manner as mentioned above. The results were:

Toner 6(C6): 5.44 eV;

Toner 7(C7): 5.41 eV;

Toner 8(C8): 5.43 eV;

Toner 9(C9): 5.41 eV;

Toner 10(C10): 5.41 eV;

Toner 11(C11): 5.44 eV;

Toner 12(C12): 5.42 eV; and

Toner 13(C13): 5.42 eV.

In the same manner as Example 1-1, for the respective obtained toners 6 (C6) through 13 (C13), image forming test in non-contact single-component developing method was conducted by loading the toner into only the cyan toner developing device 10C of the four-cycle color printer shown in FIG. 5 under the same conditions of Example 1-1. The purpose of this example is also to show the effects by the addition of metallic soap.

Charge characteristics, number liberation ratio of external additives, and the image forming test result of each toner, measured in the same manner as Example 1-1, are shown in Table 6 and Table 7.

TABLE 6

| Toner | Work function difference (eV) (toner mother particles) − (metallic soap particles) | Metallic soap particles | Solid OD value | Charge amount (μc/g) |
|---|---|---|---|---|
| Toner 6(C6) | — | None | 1.39 | −11.46 |
| Toner 7(C7) | 0.24 | M1StAl | 1.40 | −7.61 |
| Toner 8(C8) | −0.04 | M4StCa | 1.49 | −16.11 |
| Toner 9(C9) | 0.28 | M9StAl | 1.50 | −6.97 |
| Toner 10(C10) | 0.26 | M8StAl | 1.46 | −6.34 |
| Toner 11(C11) | −0.13 | M5StMg | 1.40 | −15.06 |
| Toner 12(C12) | 0.09 | M6StZn | 1.21 | −15.09 |
| Toner 13(C13) | 0.13 | M7StCa | 1.40 | −14.48 |

TABLE 7

| Toner | Number % of positively charged toner | OD value of fog toner | OD value of reverse transfer toner | Number liberation ratio (%) Si | Number liberation ratio (%) Ti |
|---|---|---|---|---|---|
| Toner 6(C6) | 3.5 | 0.02 | 0.12 | 0.85 | 1.12 |
| Toner 7(C7) | 14.1 | 0.12 | 0.33 | 0.38 | 0.64 |
| Toner 8(C8) | 2.5 | 0.01 | 0.06 | 0.56 | 0.94 |
| Toner 9(C9) | 15.5 | 0.11 | 0.23 | 0.57 | 1.07 |
| Toner 10(C10) | 27.6 | 0.19 | 0.36 | 0.75 | 1.06 |
| Toner 11(C11) | 3.1 | 0.01 | 0.06 | 0.74 | 1.01 |
| Toner 12(C12) | 4.3 | 0.02 | 0.09 | 0.74 | 1.00 |
| Toner 13(C13) | 3.0 | 0.02 | 0.08 | 0.73 | 1.06 |

As apparent from the above tables, as for the relation of work function between the toner mother particles and the metallic soap particles, it was found that the toner 8(C8) and the toner 11(C11) through the toner 13(C13) in which metallic soap particles having substantially the same work function (±0.15 eV) as that of the toner mother particles were added exhibited higher solid OD value and relatively higher charge amount, with the result that the amount of positively charged toner was reduced and the amount of fog toner and the amount of reverse transfer toner were also reduced.

It was found that the best one was calcium stearate (M4StCa) having substantially the same work function as that of the toner mother particles. As for the number liberation ratio of external additives, any one of toners in which metallic soap particles were added to toner mother particles exhibited smaller value than the toner 6(C6) as a metallic-soap-free toner. That is, it was found that the addition of metallic soap particles is effective in preventing the liberation of external additives.

Example 1-3

Yellow toner mother particles were obtained in the same manner as the toner mother particles of Example 1-1 except that Pigment Yellow 180 was used as the pigment and that polymerization was conducted in the same manner under the condition that the temperature for improving the association and the film bonding strength of secondary particles was still kept at 90° C. The yellow toner mother particles had a work function of 5.61 eV.

To the toner mother particles, the fluidity improving agents which were the same as those added in Example 1-2 and metallic soap particles shown in the following Table 8 were added and mixed so as to obtain a toner 14 (Y1) through a toner 16 (Y3) having a mean particle diameter of 7 μm and a degree of circularity of 0.972.

The work functions of the obtained toners were measured in the same manner as the toner 1. The results were:

Toner 14(Y1): 5.60 eV;

Toner 15(Y2): 5.60 eV; and

Toner 16(Y3): 5.60 eV.

In the same manner as Example 1-1, for the respective obtained toners 14(Y1) through 16(Y3), image forming test in non-contact single-component developing method was conducted by loading the toner into only the yellow toner developing device 10Y of the four-cycle color printer shown in FIG. 5 under the same conditions of Example 1-1. The purpose of this example is also to show the effects by the addition of metallic soap to the toner mother particles to which hydrophobic silica particles are externally added.

Charge characteristics, number liberation ratio of external additives, and the image forming test result of each toner, measured in the same manner as Example 1-1, are shown in Table 8 and Table 9.

TABLE 8

| Toner | Work function difference (eV) (toner mother particles) − (metallic soap particles) | Metallic soap particles | Solid OD value | Charge amount (μc/g) |
|---|---|---|---|---|
| Toner 14(Y1) | — | None | 1.30 | −14.20 |
| Toner 15(Y2) | −0.03 | M2StZn | 1.32 | −15.69 |
| Toner 16(Y3) | 0.12 | M4StCa | 1.31 | −16.60 |

TABLE 9

| Toner | Number % of positively charged toner | OD value of fog toner | OD value of reverse transfer toner | Number liberation ratio (%) Si | Number liberation ratio (%) Ti |
|---|---|---|---|---|---|
| Toner 14(Y1) | 3.0 | 0.02 | 0.08 | 0.84 | 1.10 |
| Toner 15(Y2) | 1.4 | Nearly 0 | 0.04 | 0.76 | 0.79 |
| Toner 16(Y3) | 1.5 | 0.01 | 0.04 | 0.48 | 0.89 |

As apparent from the above tables, as for the relation of work function between the toner mother particles and the metallic soap particles, it was found that the toner 15(Y2) in which metallic soap particles were added exhibited higher solid OD value and relatively higher charge amount, thereby reducing the amount of positively charged toner particles and also reducing the amount of fog toner and the amount of reversely transferred toner particles. It was found that the best one was the metallic soap particles (Zinc stearate (M2StZn)) having substantially the same work function (±0.15 eV) as that of the toner mother particles. As for the number liberation ratio of external additives, any one of toners in which metallic soap particles were added to toner mother particles exhibited smaller value than the toner 14 (Y1) as a metallic-soap-free toner. That is, it was found that the addition of metallic soap particles is effective in preventing the liberation of external additives.

Example 1-4

Magenta toner mother particles (having a mean particle diameter of about 6.9 μm, a degree of circularity of 0.972, and a work function of 5.64 eV) were obtained in the same manner as the toner mother particles of Example 1-3 except that Quinacridon was used as the pigment and black toner mother particles (having a mean particle diameter of about 6.9 μm, a degree of circularity of 0.973, and a work function of 5.49 eV) were obtained in the same manner as the toner mother particles of Example 1-3 except that Carbon Black was used as the pigment.

To 100 parts by weight of the toner mother particles, 0.5 parts by weight of hydrophobic silica particles (having a mean primary particle diameter of 12 nm) surface-treated with hexamethyldisilazane (HMDS) and 0.5 parts by weight of hydrophobic silica particles (having a mean primary particle diameter of 40 nm) surface-treated by the same treatment were added and mixed. After that, 0.5 parts by weight of hydrophobic rutile/anatase type titanium oxide particles (having a mean primary particle diameter of 20 nm and a specific surface area of 90 $m^2/g$) treated with a silane coupling agent and 0.2 parts by weight of metallic soap particles of Zinc stearate (M2StZn) in case of magenta toner or of calcium stearate (M4StCa) in case of black toner were added and mixed so as to obtain a toner 17(M1) and a toner 18(B1).

The work functions of the obtained toners were measured in the same manner as the toner 1. The results were:

Toner 17(M1): 5.64 eV; and

Toner 18(B1): 5.48 eV.

Next, successive printing tests through superposition of colors were conducted with the toners, containing metallic soap particles having substantially the same work function as that of the toner mother particles, selected from the obtained toners. A full-color printer of tandem type shown in FIG. 6 was used and the respective unicolor developing cartridges thereof were filled with the toner 4 (C4, having a work function of 5.55 eV) as a cyan toner, the toner 15 (Y2, having a work function of 5.60 eV) as an yellow toner, the toner 17 (M1, having a work function of 5.64 eV) as a magenta toner, and the toner 18 (B1, having a work function of 5.48 eV), respectively. Though the order of the developing devices are Y, C, M, K from the upstream side in the traveling direction of the transfer medium in FIG. 6, the order of the developing devices may be M, Y, C, K from the upstream side in the traveling direction of the transfer medium.

The images were developed in the non-contact developing method. The order of development were the descending order of work function, that is, the order of the magenta toner, the yellow toner, the cyan toner, and the black toner. As each of four organic photoreceptors, the OPC2 having a work function (of 5.50 eV) larger than the work function (5.48 eV) of the black toner which is the smallest among the work functions of the toners to be used was employed. The development rollers and the regulating blades were the same as used in Example 1-1. The transfer belt produced in the above was used as the intermediate transfer belt.

The regulating blade was controlled such that the carrying amount of each toner becomes from 0.38 $mg/cm^2$ to 0.40 $mg/cm^2$.

The developing bias conditions were set such that the amount of developed toner adhering to the organic photoreceptor when a solid image is printed becomes 0.5 $mg/cm^2$ to 0.53 $mg/cm^2$.

As conditions for forming images, the alternating current (AC) to be superimposed on the developing bias voltage of −200 V was set to have a frequency of 2.5 kHz and a P-P voltage of 1400 V. Under the conditions, a character image of 5% coverage per color was successively printed on 10,000 sheets of paper. The total amount of toners cleaned from the four photoreceptors and the transfer belt was measured and the measured value was 23 g. The amount of collected toners was about ⅕ of the expected amount of toners collected in the toner collecting containers.

Further, the image was successively printed on 10,000 sheets of paper in the same manner except that the organic photoreceptors were replaced with OPC4s (having a work function of 5.27 eV). The total amount of cleaned toners was measured and the measured value was 45 g. It was found that the amount of cleaned toners increases if the work function of the photoreceptors is smaller than the work function of the toner having the smallest work function among the toners.

As apparent from the results, by setting the work function of the metallic soap particles to be substantially the same as that of the toner mother particles, setting the work function of the photoreceptors to be larger than the work function of a toner having the smallest work function among toners to be used, and setting the order of development and transfer to be the descending order of work function, the transfer efficiency is significantly improved, thereby reducing the amount of cleaned toners and enabling the miniaturization of the apparatus.

Furthermore, the image was successively printed on 10,000 sheets of paper in the same manner except that the conditions were set such that the carrying amount of each toner becomes from 0.52 $mg/cm^2$ to 0.55 $mg/cm^2$ and the amount of developed toner adhering to the organic photoreceptor when a solid image is printed becomes 0.56 $mg/cm^2$ to 0.58 $mg/cm^2$. The total amount of cleaned toners was measured and the measured value was 43 g. It was found that the amount of cleaned toners can be reduced by setting the carrying amount of each toner to be 0.5 $mg/cm^2$ or less and setting the amount of adhering toner to be 0.55 $mg/cm^2$ or less.

Example 1-5

Magenta toner mother particles (having a mean particle diameter of 6.5 μm, a degree of circularity of 0.942, and a work function of 5.56 eV) were obtained in the same manner as the toner mother particles of Example 1-2 through pulverization, classification, heat treatment, and re-classification, except that 6B of Naphthol AS series was used as the pigment. To 100 parts by weight of toner mother particles, external additives were added in the same manner as Example 1-2 and, after that, 0.2 parts by weight of magnesium stearate (M3StMg) having substantially the same work function as that of the toner mother particles and 0.5 parts by weight of hydrophobic rutile/anatase type titanium oxide particles (having a mean primary particle diameter of 20 nm and a specific surface area of 90 $m^2/g$) treated with a silane coupling agent were added and mixed so as to obtain a toner 19(M2).

The work function of the obtained toner was measured in the same manner as the toner 1. The result was:

Toner 19(M2): 5.55 eV.

Further, yellow toner mother particles (having a mean particle diameter of 6.5 μm, a degree of circularity of 0.942, and a work function of 5.59 eV) were obtained in the same manner except that Pigment Yellow 180 was used as the pigment. To 100 parts by weight of toner mother particles, external additives were added in the same manner as Example 1-2 and, after that, 0.2 parts by weight of magnesium stearate (M5StMg) having substantially the same work function as that of the toner mother particles and 0.5 parts by weight of hydrophobic rutile/anatase type titanium oxide particles (having a mean primary particle diameter of 20 nm and a specific surface area of 90 $m^2/g$) treated with a silane coupling agent were added and mixed so as to obtain a toner 20(Y4).

The work function of the obtained toner was measured in the same manner as the toner 1. The result was:

Toner 20(Y4): 5.58 eV.

Furthermore, black toner mother particles (having a mean particle diameter of 6.5 μm, a degree of circularity of 0.942, and a work function of 5.65 eV) were obtained in the same manner except that carbon black was used as the pigment.

To 100 parts by weight of toner mother particles, external additives were added in the same manner as Example 1-2 and, after that, 0.2 parts by weight of Zinc stearate (M2StZn) having substantially the same work function as that of the toner mother particles and 0.5 parts by weight of hydrophobic rutile/anatase type titanium oxide particles (having a mean primary particle diameter of 20 nm and a specific surface area of 90 $m^2/g$) treated with a silane coupling agent were added and mixed so as to obtain a toner 21(B2).

The work function of the obtained toner was measured in the same manner as the toner 1. The result was:

Toner 21(B2): 5.64 eV.

Next, successive printing tests through superposition of colors were conducted with the toners, containing metallic soap particles having substantially the same work function as that of the toner mother particles, selected from the obtained toners and by employing a full-color printer of one-time transfer type shown in FIG. 4. The respective unicolor developing cartridges thereof were filled with the toner 8 (C8, having a work function of 5.43 eV) as a cyan toner, the toner 19 (M2, having a work function of 5.55 eV) as a magenta toner, the toner 20 (Y4, having a work function of 5.58 eV) as an yellow toner, and the toner 21 (B2, having a work function of 5.64 eV), respectively and were installed to the printer.

As the organic photoreceptor, the OPC3 having a work function (5.47 eV) larger than the work function (5.43 eV) of the cyan toner which is the smallest among the work functions of the toners to be used was employed. The development rollers and the regulating blades were the same as used in Example 1-1. Though the order of the developing devices are M, Y, C, K from the upstream of the photoreceptor in the apparatus shown in FIG. 4, the order of the developing devices may be K, Y, M, C from the upstream of the photoreceptor.

The images were developed in the non-contact developing method. The order of development were the descending order of work function, that is, the order of the black toner (work function of 5.64 eV), the yellow toner (work function of 5.58 eV), the magenta toner (work function of 5.55 eV), and the cyan toner (work function of 5.43 eV).

For forming images, the peripheral velocity of the organic photoreceptor was set to 200 mm/sec. The development rollers are set to have a peripheral velocity ratio of 1:4 relative to the organic photoreceptor. The regulation by the toner regulating blade was controlled so as to set the carrying amount of toner on the development roller to be from 0.4 $mg/cm^2$ to 0.43 $mg/cm^2$ such that each unicolor toner forms substantially a single layer. The developing gap between the development roller and the photoreceptor was set to 210 μm (the space was adjusted by a gap roller) and an alternating current to be superimposed on the direct current developing bias of −200 V was set to have a frequency of 2.5 kHz and a P-P voltage of 1400 V, and the development roller and the supply roller were set to have the same potential. The successive printing test was conducted by successively printing a character image of 5% coverage per color (including characters and/or linear drawings) on 10,000 sheets of paper. After that, the amount of toner cleaned from the photoreceptor was measured and the measured value was 85 g.

As a comparative example, four unicolor toners were prepared in the same manner except that aluminum stearate (M9StAl) having a work function far from the work function of the toner mother particles were added and the development and the transfer were conducted with the toners in the descending order of work function. In this manner, the image was successively printed on 10,000 sheets of paper. The amount of toner cleaned from the photoreceptor was measured and the measured value was about 180 g.

As mentioned above, the addition of metallic soap particles does not inhibit the transfer of electrons (charge) to the toner layer which has been first developed and achieves the superposition of the respective unicolor toner layers with a focus on the toner layer which has been first developed, therefore leading to the improvement of color reproducibility and improvement of image quality without toner scattering and also improving the transfer efficiency. In addition, reduction in amount of cleaned toner, further reduction in size of a waste toner box, and reduction in size of a full-color printer can be also achieved.

As a comparative example, a photoreceptor (OPC5, work function of 5.27 eV) having a work function smaller than that of the aforementioned cyan toner (work function of 5.43 eV) was employed. Under this condition, the image was successively printed on 10,000 sheets of paper in the same manner as mentioned above. The amount of toner cleaned from the photoreceptor was measured and the measured value was about 105 g. As apparent from the result, the transfer efficiency is improved when the organic photoreceptor has a work function substantially equal to or larger than the work function of a toner having the smallest work function among used toners, with the result that the amount of toner cleaned from the photoreceptor is reduced.

Example 2-1

Production Example of Toner T1

A monomer mixture composed of 80 parts by weight of styrene monomer, 20 parts by weight of butyl acrylate, and 5 parts by weight of acrylic acid was added into a water soluble mixture composed of 105 parts by weight of water, 1 part by weight of nonionic emulsifier (Emulgen 950 available from Dai-ichi Kogyo Seiyaku Co., Ltd.), 1.5 parts by weight of anionic emulsifier (Neogen R available from Dai-ichi Kogyo Seiyaku Co., Ltd.), and 0.55 parts by weight of potassium persulfate and was agitated and polymerized in nitrogen gas atmosphere at a temperature of 70° C. for 8 hours. By cooling after polymerization reaction, milky white resin emulsion having a particle size of 0.25 μm was obtained.

Then, a mixture composed of 200 parts by weight of resin emulsion obtained above, 20 parts by weight of polyethylene wax emulsion (available from Sanyo Chemical Industries, Ltd.), and 7 parts by weight of Phthalocyanine Blue was dispersed into water containing dodecyl benzene sulfonic acid sodium in an amount of 0.2 parts by weight, and was adjusted to have pH of 5.5 by adding diethyl amine. After that, 0.3 parts by weight of aluminum sulfate was added as an electrolyte with agitation and subsequently agitated at a high speed and thus dispersed by using an agitator (TK homo mixer manufactured by Tokushu Kika Kogyo Co., Ltd.).

Further, 40 parts by weight of styrene monomer, 10 parts by weight of butyl acrylate, and 5 parts by weight of zinc salicylate were added with 40 parts by weight of water, agitated in nitrogen gas atmosphere, and heated at a temperature of 90° C. in the same manner. By adding hydrogen peroxide solution, polymerization was conducted for 5 hours to grow up particles. After the polymerization, the pH was adjusted to be 5 or more while the temperature was increased to 95° C. and then maintained for 5 hours in order to improve the bonding strength of associated particles.

After that, the obtained particles were washed with water and dried under vacuum at a temperature of 45° C. for 10 hours. The cyan toner obtained in this manner has a mean particle diameter of 6.8 μm and a degree of circularity of 0.98.

The measurement of degree of circularity was conducted by using a flow-type particle analyzer (FPIA2100 available from Sysmex corporation) and was represented by the following equation (1):

$$R=L_0/L_1 \quad (1)$$

wherein "$L_1$" is the circumferential length (μm) of a projected image of an object toner particle, and "$L_0$" is the circumferential length (μm) of a perfect circle having the same area as that of the projected image.

To 100 parts by weight of the obtained toner, hydrophobic silica having a mean primary particle diameter of 12 nm was added in an amount of 1 parts weight and hydrophobic silica having a mean particle diameter of 40 nm was added in an amount of 0.7 parts by weight, as fluidity improving agents. Then, hydrophobic titanium oxide having a mean primary particle diameter of 20 nm was added in an amount of 0.5 parts by weight, positively chargeable hydrophobic silica prepared by surface-treating hydrophobic silica having a mean primary particle diameter of 30 nm with aminosilane was added in an amount of 0.4 parts by weight and were mixed so as to obtain a toner T1.

The mean particle diameter was indicated in volume distribution D50 measured by an electric-resistance particle size distribution analyzer (MULTISIZER III available from Beckman Coulter, Inc.).

The work function of the obtained toner was 5.54 eV. In this example, the work function was measured by a surface analyzer (AC-2 manufactured by Riken Keiki Co., Ltd) with radiation amount of 500 nW.

Production Example of Toner T2

A toner T2 was prepared in the same manner as the toner T1 except that Quinacridon was used as the pigment instead of Phthalocyanine Blue and that the temperature for improving the association and the film bonding strength of secondary particles was still kept at 90° C. This magenta toner had a degree of circularity of 0.972 and a work function of 5.63 eV. The mean particle diameter based on the number of this toner was 6.9 μm.

Production Examples of Toners T3, T4

A yellow toner T3 having a degree of circularity of 0.972, a work function of 5.58 eV, and a mean particle diameter of about 7.0 μm was prepared in the same manner as the toner T2 except that Pigment Yellow 180 was used as the pigment and a black toner T4 having a degree of circularity of 0.973, a work function of 5.48 eV, and a mean particle diameter of about 6.9 μm was prepared in the same manner as the toner T2 except that Carbon Black was used as the pigment.

Production Example of Toner 5

100 parts by weight of a mixture (HIMER ES available from Sanyo Chemical Industries, Ltd.) which was 50:50 (by weight) of polycondensate polyester, composed of aromatic di-carboxylic acid and bisphenol A of alkylene ether, and partially crosslinked compound of the polycondensate polyester by polyvalent metal, 5 parts by weight of Pigment Blue 15:1 as a cyan pigment, 1 part by weight of polypropylene having a melting point of 152° C. and a weight-mean molecular weight Mw of 4000 as a release agent, and 4 parts by weight of metal complex compound of salicylic acid E-81 (available from Orient Chemical Industries, Ltd.) as a charge control agent were uniformly mixed by using a Henschel mixer, then kneaded by a twin-shaft extruder at an inner temperature of 130° C., and then cooled.

The cooled matter was roughly pulverized into pieces of 2 square mm or less and then pulverized into fine particles by a jet mill. The fine particles were classified by a classifier of rotor type, thereby obtaining classified toner particles having a mean particle diameter of 6.2 μm and a degree of circularity of 0.905. The classified toner was surface-treated by adding hydrophobic silica (having a mean primary particle diameter of 7 nm and a specific surface area of 250 $m^2/g$ according to the BET method) in an amount of 0.2 parts by weight relative to 100 parts by weight of the classified toner and then was partially spheroidized by using a hot air spheroidizing apparatus (available from Nippon Pneumatic Mfg. Co., Ltd.) at a treatment temperature of 200° C. After that, the surface-treated toner was classified again in the same manner, thereby forming mother particles of a cyan toner having a mean particle diameter of 6.3 μm and a degree of circularity of 0.940. A fluidity improving agent was added to and mixed with the toner mother particles in the same manner as the toner T1 so as to produce the toner T5. The work function of the obtained toner was measured and the measured value was 5.48 eV.

Production Examples of Toners T6, T7, T8

A magenta toner T6 having a mean particle diameter of 6.5 μm and a degree of circularity of 0.942 was obtained in the same manner as the production example of toner T5 through pulverization, classification, heat treatment, re-classification, and surface treatment except that 6B of Naphthol AS series was used as the pigment. The work function of the obtained toner was measured and the measured value was 5.53 eV.

In the same manner, a toner T7 (using Pigment yellow 93 for an yellow toner) and a toner T8 (using carbon black for a black toner) were produced. The mean primary particle diameter and the degree of circularity of each of the obtained toner were substantially the same as those of the toner T6 and the work functions of the respective toners were 5.57 eV (yellow: T7) and 5.63 eV (black: T8).

(Image Formation and Evaluation)

By using a color printer of tandem type shown in FIG. 9 in which the organic photoreceptors (OPC2), the development rollers, the regulating blades, and the feeding belt previously prepared were assembled and installing the respective toner image forming means loaded with the aforementioned toners T1 through T4, the image forming test of non-contact single-component developing method was conducted.

The conditions for forming images were as follows. That is, the peripheral velocity of each organic photoreceptor was set to 180 mm/s, the peripheral velocity of the each development roller was set to be higher than that of the photoreceptor by 1.6 times and, as for the standard image forming conditions, the dark potential of the photoreceptor was set to −600 V, the light potential of the same was set to −80 V, the developing gap between the development roller and the photoreceptor was set to 210 μm (the space was adjusted by a gap roller), an alternating current to be superimposed on the direct current developing bias of −200 V was set to have a frequency of 2.5 kHz and a P-P voltage of 1400 V, and the development roller and the supply roller were set to have the same potential.

Images were printed under condition in which the temperature was 23° C. and the humidity was 55% RH with controlling the amount of developed toner adhering to each photoreceptor to be 0.53 mg/cm$^2$ or less maximum for each color when a solid image is printed.

The regulation by the toner regulating blade mentioned above was changed so as to set the carrying amount of toner on the development roller to be from 0.4 mg/cm$^2$ to 0.43 mg/cm$^2$.

As for the conditions for forming images, the dark potential of the photoreceptor was set to −600 V, the light potential of the same was set to −80 V, the developing bias was −200 V, and the development roller and the supply roller were set to have the same potential. The power source for the primary transfer portion was a constant current source of direct current. The current value of the transfer current was controlled at the first color and the fourth color such that the current value at the first color was 8 μA and the current value was increased by 2 μA for every color from the second color.

The color printer of tandem type shown in FIG. 9 is a cleaner-less printer without cleaning members near the photoreceptors.

The print test was conducted by successively printing a character image of 5% coverage per color on 10,000 sheets of paper and successively printing an image N-2A (cafeteria) of Standard color image data compliant with JIS X9201-1995 on 5,000 sheets of paper.

The image forming means are arranged in the descending order of work function from the upstream side in the traveling direction of the sheet feeding belt such that the next one has a work function smaller than the former one.

In this embodiment, the first toner image forming means is loaded with the black toner. When the order of the arrangement was changed, the order of the image data processing was also changed before printing.

In this case, as for the initial quality of outputted printed images, possible color registration error was observed by visual check after printing the image of 5% coverage per color on 10,000 sheets. In addition, possible entire color registration error was observed on an output printed image of N-2A as a photograph by visual check.

The used toners were the toner T1 (Mark: TC1, Work function: 5.54 eV) as a cyan toner, the toner T2 (Mark: TM2, Work function: 5.63 eV) as a magenta toner, the toner T3 (Mark: TY3, Work function: 5.58 eV) as an yellow toner, and the toner T4 (Mark: TBK4, Work function: 5.48 eV) as a black toner. The used recording media were electrophotographic paper sheets (PPC paper L available from Fuji Xerox Office Supply) having a work function of 5.61 eV.

The results are shown in Table 10.

TABLE 10

| Test Examples (development/transfer order) | Number sheet on which color registration error was visually found: 5% coverage | Number sheet on which color registration error was visually found: N-2A |
|---|---|---|
| Test example 2-1 (TM2-TY3-TC1-TBK4) | 10,000$^{th}$ | 4,700$^{th}$ |
| Comparative test example 2-1 (TC1-TM2-TY3-TBK4) | 7,200$^{th}$ | 2,700$^{th}$ |
| Comparative test example 2-2 (TY3-TC1-TM2-TBK4) | 7,200$^{th}$ | 2,700$^{th}$ |
| Comparative test example 2-3 (TBK4-TC1-TM2-TY3) | 5,800$^{th}$ | 2,000$^{th}$ |

It was found from the results shown in Table 10 that the development/transfer conducted with toners in the descending order of larger work function enables cleaner-less image formation even with no cleaning means. The obtained printed matters provided high quality image without color registration error.

However, when the regulation of the toner regulating blade was controlled such that the carrying amount of toner on the development roller becomes more than 0.5 mg/cm$^2$, concretely about 0.52 mg/cm$^2$, and/or when the amount of developed toner adhering to the photoreceptor was set to be 0.55 mg/cm$^2$ or more maximum for each color for a solid image, it is impossible to print the same number of printed sheets of paper as Example 2-1 unless using a cleaning means.

These characteristics mean that it is required to enable the toner to be uniformly negatively charged and to set the amount of adhering toner for a solid image to be such an amount enabling toner layers to be in uniform contact with each other or less.

Example 2-2

Image forming test was conducted in the same manner as Example 2-1 except that the OPC6 was used as the photoreceptor and a cleaning means was mounted.

The used toners were the toner T5 (Mark: TC5, Work function: 5.48 eV) as a cyan toner, the toner T6 (Mark: TM6, Work function: 5.53 eV) as a magenta toner, the toner T7 (Mark: TY7, Work function: 5.57 eV) as an yellow toner, and the toner T8 (Mark: TBK8, Work function: 5.63 eV) as a black toner. The used recording media were electrophotographic paper sheets (PPC paper L available from Fuji Xerox Office Supply). In this manner, the test and evaluation were conducted.

The image forming means are arranged in the descending order of work function of toner from the upstream side in the traveling direction of the sheet feeding belt such that the next one has a work function smaller than the former one. In this example, the first toner image forming means was loaded with the cyan toner and the fourth toner image forming means was loaded with the black toner. When the order of the arrangement was changed, the order of the image data processing was also changed before printing.

The structure of the development roller and the structure of the regulating blade were the same as mentioned above. The regulation by the toner regulating blade was set so that the carrying amount of toner on the development roller becomes from 0.4 mg/cm$^2$ to 0.43 mg/cm$^2$. The power source for the transfer portion was a constant current source. The successive printing was conducted with a constant current of 14 μA.

Image formation was conducted with applying an alternating current to be superimposed on the direct current developing bias of −200 V set to have a frequency of 2.5 kHz and a P-P voltage of 1400 V, and the quality of printed images was evaluated by successively printing a character image of 5% coverage per color on 10,000 sheets of paper. For the evaluation, an image N-2A (cafeteria) of Standard color image data compliant with JIS X9201-1995 was printed before the successive printing and was printed again on a sheet of paper after the image of 5% coverage per color was printed on 2,000 sheets of paper. The evaluation was based on the quality of output of the image N-2A, particularly on color registration error at half tone portions so that changes at the half tone portions from the first printed one were visually checked. When color registration error was clearly found, the printing was stopped, so the final number of printed sheets of paper was the last one at this point.

The results are shown in Table 11. "A" means an image with no problem, "B" means an image acceptable to practical use, and "C" means an image with inferior quality on which color registration error was found.

TABLE 11

| Test Examples | Whether color registration error occurs | | | | | |
|---|---|---|---|---|---|---|
| (development/transfer order) | First | 2000$^{th}$ | 4000$^{th}$ | 6000$^{th}$ | 8000$^{th}$ | 10000$^{th}$ |
| Test example 2-2 (TBK8-TY7-TM6-TC5) | A | A | A | A | A | A |
| Comparative test example 2-4 (TBK8-TM6-TC5-TY7) | A | A | A | A | A | B |
| Comparative test example 2-5 (TBK8-TC5-TM6-TY7) | A | A | A | A | A | B |
| Comparative test example 2-6 (TY7-TC5-TM6-TBK8) | A | A | A | A | A | B |
| Comparative test example 2-7 (TM6-TC5-TY7-TBK8) | A | A | A | A | B | C |
| Comparative test example 2-8 (TY7-TC5-TBK8-TM6) | A | A | A | A | B | C |
| Comparative test example 2-9 (TM6-TBK8-TC5-TY7) | A | A | A | A | B | C |
| Comparative test example 2-10 (TY7-TC5-TM6-TBK8) | A | A | A | A | B | C |
| Comparative test example 2-11 (TC5-TM6-TY7-TBK8) | A | A | A | A | B | C |

As apparent from the above, it was found that by conducting the development and transfer with toners in the descending order of work function, deterioration in printing quality does not occur. This is attributed to the fact that charge transfer is caused between toner layers so as to increase the contact between the toner layers, thereby improving the effect of preventing toner scattering and preventing color registration error and also improving the transfer efficiency. Therefore, stable quality of images can be maintained. It is also found that as the order of development and transfer is set at random with regard to the work functions of the used toners, the quality of printed image is adversely affected, particularly the quality about color registration error is adversely affected. The test showed that it is not good to arrange a toner image forming means loaded with a toner having a small work function at the first.

It was found from the result shown in Table 11 that when the transfer is conducted directly on a recording medium having a relatively large work function of about 5.6 eV, it is preferable to arrange the toner image forming means in descending order of work function of loaded toner such that the toner image forming means loaded with a toner having a large work function at the first.

If the amount of adhering toner developing an unicolor solid image on the organic photoreceptor was set to 0.6 mg/cm$^2$ or more, the transfer efficiency is reduced, leading to the increase in amount of cleaned toner. As a result of reduction in number of printable sheets per unit amount of toner, the color image forming apparatus can not exhibit good efficiency.

Though the amount of cleaned toner was 30 g after the image of 5% coverage per color is printed on 10,000 sheet of A4 paper in Test Example 2-2, the amount of cleaned toner was in a range of from 50 g to 80 g in Comparative Test Examples.

In toners of different colors of which color superposition was conducted during development of latent images on a latent image carrier or during transfer to a recording medium after the development and an image forming apparatus employing the toners, the present invention can improve the transfer efficiency, can prevent toner scattering, color registration error, toner dispersal, irregularities in image, defects of transferred colorant, and unevenness in transfer, therefore improves the color reproducibility, can significantly reduce the amount of waste toner, and enables the miniaturization of the image forming apparatus itself, and can extend the lives of the latent image carrier and a cleaning blade, thereby achieving the reduction in running cost.

In a color image forming apparatus of tandem type in which toner images formed on latent image carriers are transferred to a recording medium fed by a feeding belt, toner image forming means are arranged in descending order of work function of loaded toners from the upstream side in the traveling direction of the feeding belt so as to form a color image on a paper sheet through the developing step, the transferring step, and the fixing step, thereby preventing a toner previously transferred on the paper sheet from being reversely transferred to the photoreceptor of the next toner image forming means, increasing the contact between toner layers, and thus enabling formation of a color image in which color registration error is prevented and which is excellent in color reproducibility.

Since the increased contact between toner layers prevents the toner scattering, the inside of the image forming apparatus can be prevented from being contaminated and the feeding belt can thus prevented from being contaminated, thereby preventing backs of paper sheets from being contaminated.

I claim:

1. A method for forming electrostatic latent images on a latent image carrier comprising:

developing latent images using toners of different colors each in which a coloring agent selected from a group consisting of at least yellow, magenta, cyan, and black is internally added thereto and hydrophobic silica particles and metallic soap particles are externally added to toner mother particles to form toner images and, transferring the toner images to a recording medium, wherein color superposition of the toners is conducted during the development of latent images on the latent image carrier or during the transfer of the toner images to the recording medium after the development, wherein:

an absolute value of a difference between work functions of two of said toners is 0.02 eV or more, the color superposition is conducted sequentially from a toner having the largest work function in descending order of work function of the toners, an absolute value of a difference between a work function of the toner mother particles and a work function of the metallic soap particles is 0.15 eV or less, and a work function of the latent image carrier is larger than the work function of the toner having the smallest work function.

2. The image forming method as claimed in claim 1, a difference (absolute value) between the work function of the latent image carrier and a work function of the toner having the smallest work function is 0.07 eV or less.

3. The image forming method as claimed in claim 1, wherein the work function of the latent image carrier is from 5.35 eV to 5.6 eV.

4. The image forming method as claimed in claim 1, wherein the toners are negatively chargeable toners and the latent image carrier is a negatively chargeable organic photoreceptor so that a reversal development is conducted.

5. The image forming method as claimed in claim 1, wherein the toners are non-magnetic single-component toners and a feeding amount of each toner is controlled to be 0.5 $mg/cm^2$ or less into a thin layer.

6. The image forming method as claimed in claim 1, wherein the toners are non-magnetic single-component toners and an amount of each toner developing the image on the latent image carrier is set to be 0.55 $mg/cm^2$ or less.

7. The image forming method as claimed in claim 1, wherein the recording medium is a paper sheet or a synthetic resin film.

* * * * *